US010939718B2

(12) United States Patent
Teetzel et al.

(10) Patent No.: US 10,939,718 B2
(45) Date of Patent: Mar. 9, 2021

(54) MODULAR HELMET INTERFACE

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 16/151,899

(22) Filed: Oct. 4, 2018

(65) Prior Publication Data

US 2019/0098952 A1 Apr. 4, 2019

Related U.S. Application Data

(60) Provisional application No. 62/567,923, filed on Oct. 4, 2017.

(51) Int. Cl.

| | |
|---|---|
| ***A42B 3/00*** | (2006.01) |
| ***A42B 3/04*** | (2006.01) |
| *F41H 1/08* | (2006.01) |

(52) U.S. Cl.

CPC ..... *A42B 3/0406* (2013.01); *A42B 3/04* (2013.01); *F41H 1/08* (2013.01)

(58) Field of Classification Search

CPC ..... A42B 3/04; A42B 3/0406; F41H 1/08

USPC ..... 224/181

See application file for complete search history.

(56) References Cited

U.S. PATENT DOCUMENTS

| | | | | |
|---|---|---|---|---|
| 6,457,838 | B1 * | 10/2002 | Dugmore | F21L 15/14 362/106 |
| 9,872,531 | B2 * | 1/2018 | Uke | A42B 3/04 |
| 10,383,387 | B2 * | 8/2019 | Gendron | A42B 3/30 |
| 2015/0351482 | A1 * | 12/2015 | Gendron | A42B 3/04 2/422 |
| 2019/0098952 | A1 * | 4/2019 | Teetzel | A42B 3/04 |
| 2019/0104797 | A1 * | 4/2019 | Teetzel | A42B 3/0406 |
| 2019/0107247 | A1 * | 4/2019 | Teetzel | F16M 13/02 |

* cited by examiner

*Primary Examiner* — Peter N Helvey

(74) *Attorney, Agent, or Firm* — McLane Middleton, Professional Association

(57) ABSTRACT

A modular helmet interface with a mounting cleat and adhesive layer is provided. In one aspect, a mounting cleat is affixed to a helmet, such as a ballistic helmet, by an adhesive layer, the mounting cleat having a cavity filled with the adhesive used to secure the cleat to the helmet. In a further aspect, the mounting cleat has one or more annular grooves for improving the bond between the cleat and the helmet. In another aspect, a mounting cleat is secured to a helmet by way of a cleat-receiving securing member, the securing member affixed to the helmet by an adhesive layer.

8 Claims, 25 Drawing Sheets

MODULAR HELMET INTERFACE

RELATED APPLICATIONS

This application claims the priority benefit of U.S. provisional application 62/567,923 filed Oct. 4, 2017, entitled "Modular Helmet Interface." The aforementioned provisional application is incorporated herein by reference in its entirety.

BACKGROUND

The present disclosure relates to a modular interface for a helmet and, in particular, to a modular helmet mount system to accommodate the mounting of various accessory devices to a protective helmet such as a ballistic combat helmet or other protective helmet or headgear.

Prior art helmet mounting systems commonly rely on one or more holes formed in the helmet for attaching a night vision mounting system. Exemplary hole patterns include single-hole patterns, such as the Standard One-Hole pattern, multiple-hole patterns, such as the Standard Three-Hole pattern.

Ballistic helmets derive their ballistic protection from a shell formed of highly consolidated layers of polymer impregnated aramid fiber (e.g., Kevlar fabric impregnated with a polyvinyl butyral (PVB)-phenolic resin). When one or more holes are drilled in the shell, the ballistic integrity is compromised, both because of the voids such holes create in the ballistic structure, as well as because of the ability of moisture to infiltrate the composite material at the site of the holes and cause separation of the ballistic plies over time.

When holes are drilled in the ballistic shell, the ballistic integrity of the shell may be compromised. This can be mitigated somewhat when the holes are drilled by the manufacturer at the factory before the shells are sprayed with a sealant finish to insure the holes are sealed from moisture, which would otherwise cause the ballistic fabric layers to separate over time and lose their ballistic protective properties. Nonetheless, even when properly sealed at the factory, the underlying ballistic structure of the helmet is weakened where the holes are drilled and must be mitigated by the use of ballistic grade mounting hardware, including, e.g., the threaded inserts bonded into the holes by the manufacturer and ballistic screws used for securing hardware to the helmet, even when the holes are not being used.

Sometimes it is desired to attach mounting hardware to a helmet that has been predrilled with a hole pattern differing from the hole pattern of the mounting hardware. In such cases, a user will drill new holes to accommodate the mounting hardware. Drilling new holes disrupts the sealant finish on the helmet, which may allow the ballistic fabric layers to separate due to moisture absorption, and weakens the composite structure of the helmet. When holes are drilled by the end user, there is also a risk that the holes may not be in the correct position on the helmet.

The present disclosure contemplates a new and improved helmet mounting interface and method which does not require holes to be drilled in the ballistic shell of the helmet.

SUMMARY

In one aspect, a helmet mount system comprises a mounting cleat, the mounting cleat having a front surface, a back surface, and an adhesive layer, configured to couple the back surface to a mounting surface.

In another aspect, a helmet mount system comprises a mounting cleat, the mounting cleat having a first front surface, a first back surface. A securing member has a second front surface and a second back surface. A first adhesive layer is configured to couple the second back surface to a mounting surface.

In yet another embodiment, a helmet mount system comprises one or more mounting cleats, each of said one or more mounting cleats having a front surface and a back surface. A securing member has one or more apertures, each of said one or more apertures corresponding to the one or more mounting cleats. An adhesive layer is configured to couple the securing member to a mounting surface.

One advantage of the present development is that it does not require holes to be drilled through the ballistic shell of the helmet, thereby maintaining ballistic integrity of the helmet.

Another advantage resides in adaptability for interchangeably attaching a variety of devices to be mounted, including without limitation, night vision devices, battery packs, illuminating devices, friend foe systems, rail-type accessory mounts including Picatinny, NATO Accessory Rail (NAR), Standardization Agreement (STANAG) 2324 rail, MIL-STD 1913 rail, and other rail-type mounts, to provide a modular helmet system.

Another advantage of the present helmet mounting interface system is that it is independent of the helmet material and the geometric shape and size of the helmet.

Still another advantage of the present system resides in its relatively low profile, which reduces the snag hazards associated with the mounting interface, and which snag hazard is further mitigated with removable covers.

Yet another advantage of the present development is that it is readily amenable to standardization, which enables it to define a common interface that multiple manufactures can design to, thereby further increasing the modularity of the system and the range of accessory options available. Just as the Picatinny weapon rail interface standard has greatly increased intercompatibility among weapon-mounted accessory devices, it is contemplated that the present development can be standardized to increase intercompatibility among helmet-mounted accessory devices.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

FIGS. 11 and 12 illustrate a preferred configuration for mounting a shroud (for example, a shroud of the type providing helmet mount interface, e.g., for a night vision device or other viewing device) on the forward portion of the helmet and battery compartment dock on the aft portion of the helmet, wherein there are two cleats forward and two cleats aft.

DETAILED DESCRIPTION OF THE PREFERRED EMBODIMENTS

Figure 1:
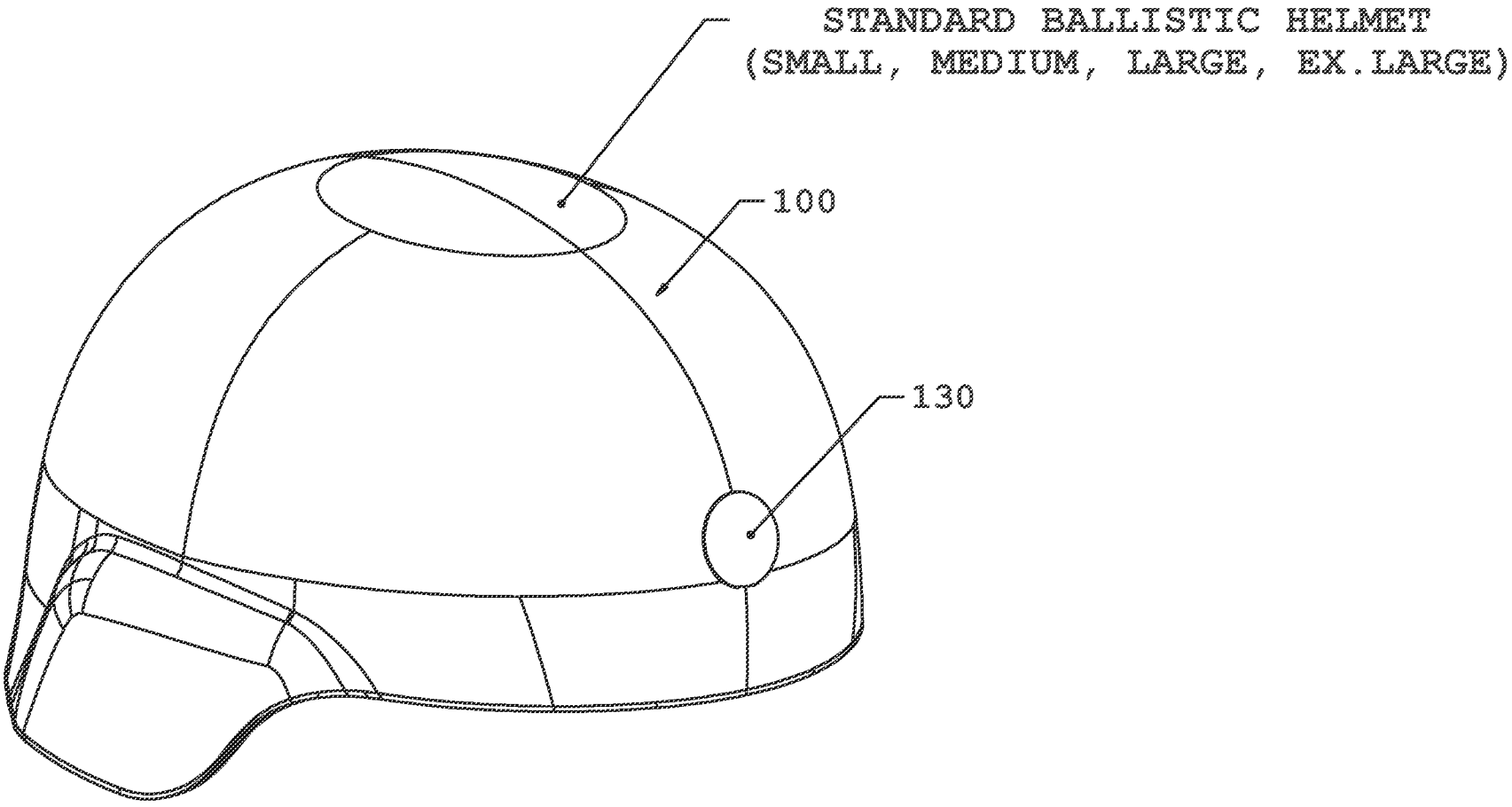
FIG. 1 is an isometric view of a helmet mount system according to a first exemplary embodiment.

Referring now to the drawings, FIGS. 1, 1A, 2-5, 5A, 6, 6A, and 7-12 illustrate a first exemplary cleat design and FIGS. 13-22 illustrate a second exemplary cleat design. The first cleat design is preferably hard-coated aluminum. The second cleat design is preferably assembled to the helmet by the helmet manufacturer. Referring now to FIG. 1, there is shown an isometric view of an exemplary helmet 100 having one mounting cleat 110 in accordance with this disclosure attached to the front and central portion of the helmet. It will be recognized that the illustrated embodiment is exemplary only and that the embodiment of FIG. 1 can be adapted for positioning at any one or more locations on the helmet, including, for example, the rear, side(s), top, and elsewhere. In certain embodiments, the illustrated helmet 100 is a military combat helmet such as a ballistic fiber combat helmet (e.g., Advanced Combat Helmet (ACH)), although protective helmets formed of other materials such as thermoplastics, metals, etc., are also contemplated.

Figure 1A:
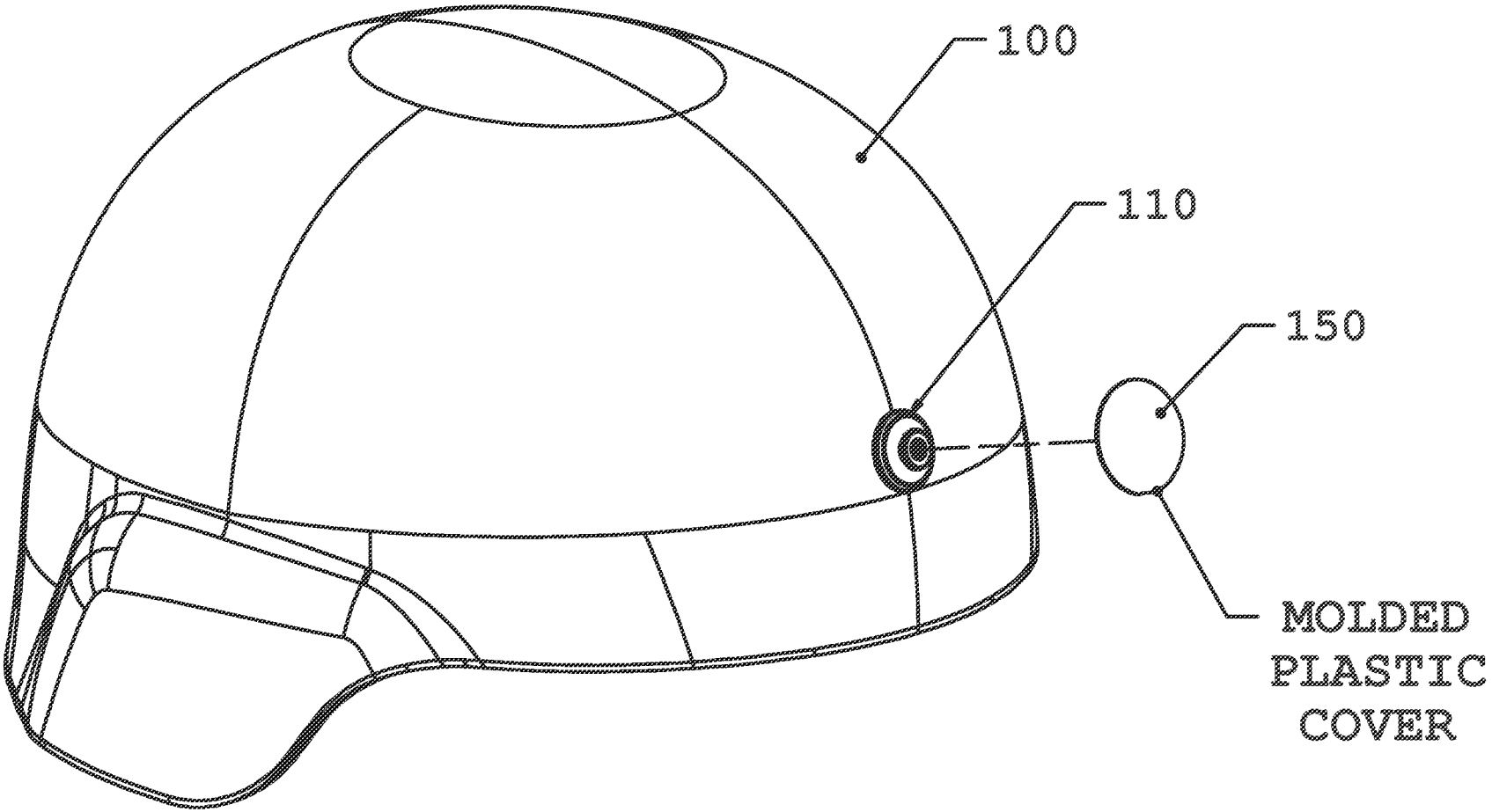
FIG. 1A is a partially exploded view of the embodiment appearing in FIG. 1.
Figure 2:
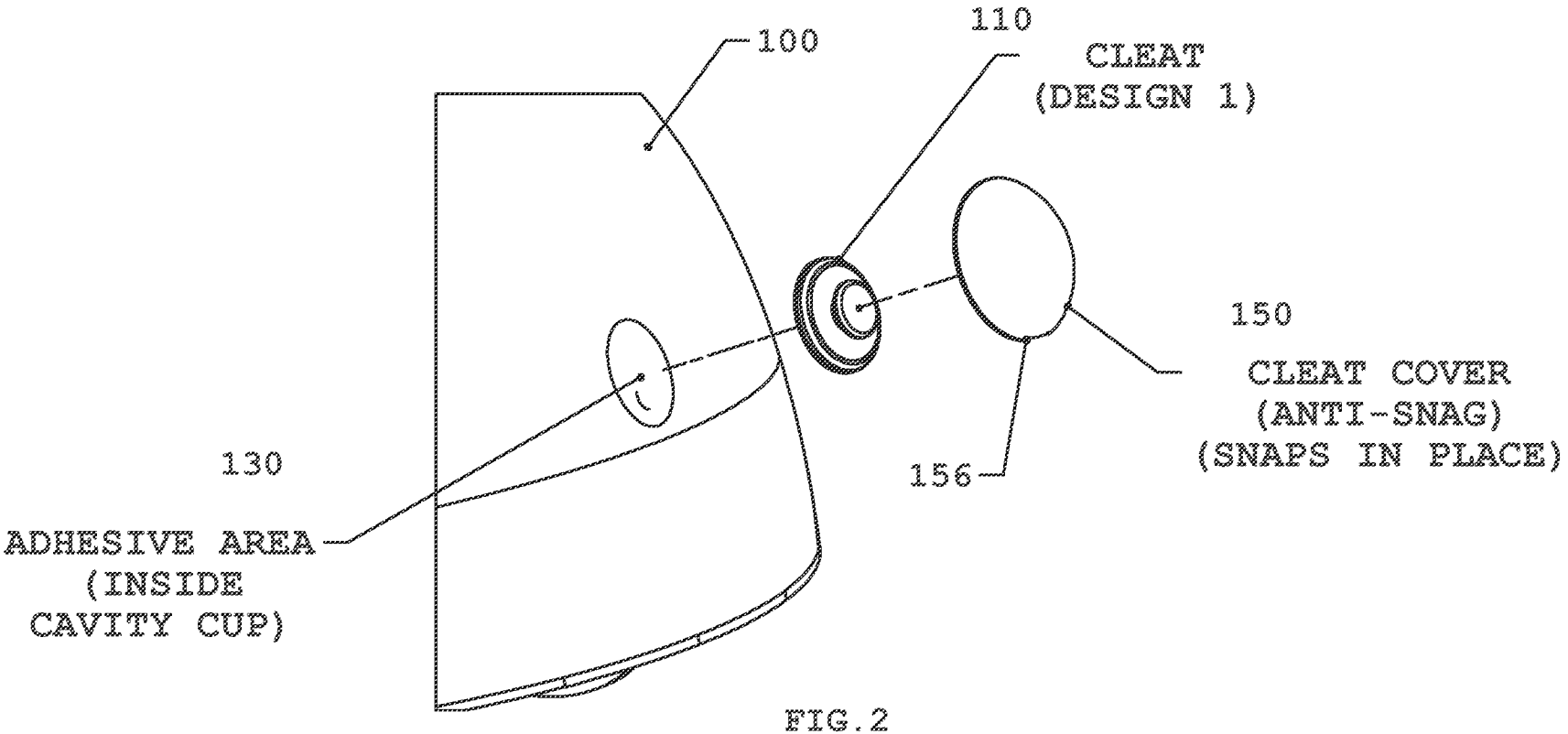
FIG. 2 is a fragmentary exploded view of the embodiment appearing in FIG. 1.

FIG. 2 is a fragmentary, exploded view of the helmet and cleat system appearing in FIG. 1. The cleat system includes the cleat 110, which is secured to the helmet surface with an adhesive 130. The cleat system may further include an optional cover 150, which provides an anti-snag function and snaps into the cleat groove. FIG. 1A is an isometric view of the helmet 100 which is similar to the view seen in FIG. 1, with the cover 150 removed.

Figure 3:
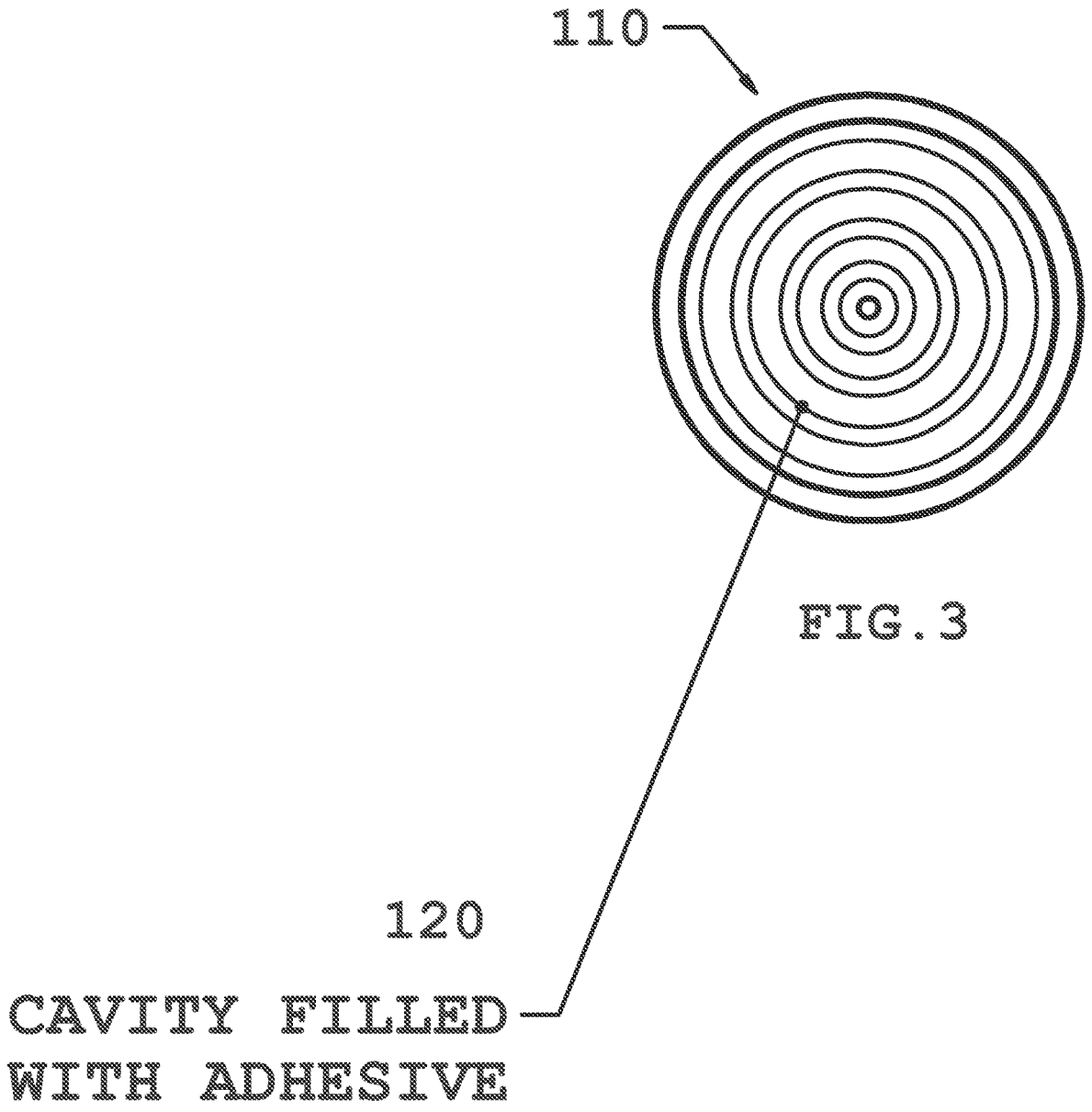
FIG. 3 is a bottom view of the mounting cleat portion of the helmet mount system appearing in FIG. 1.
Figure 4:
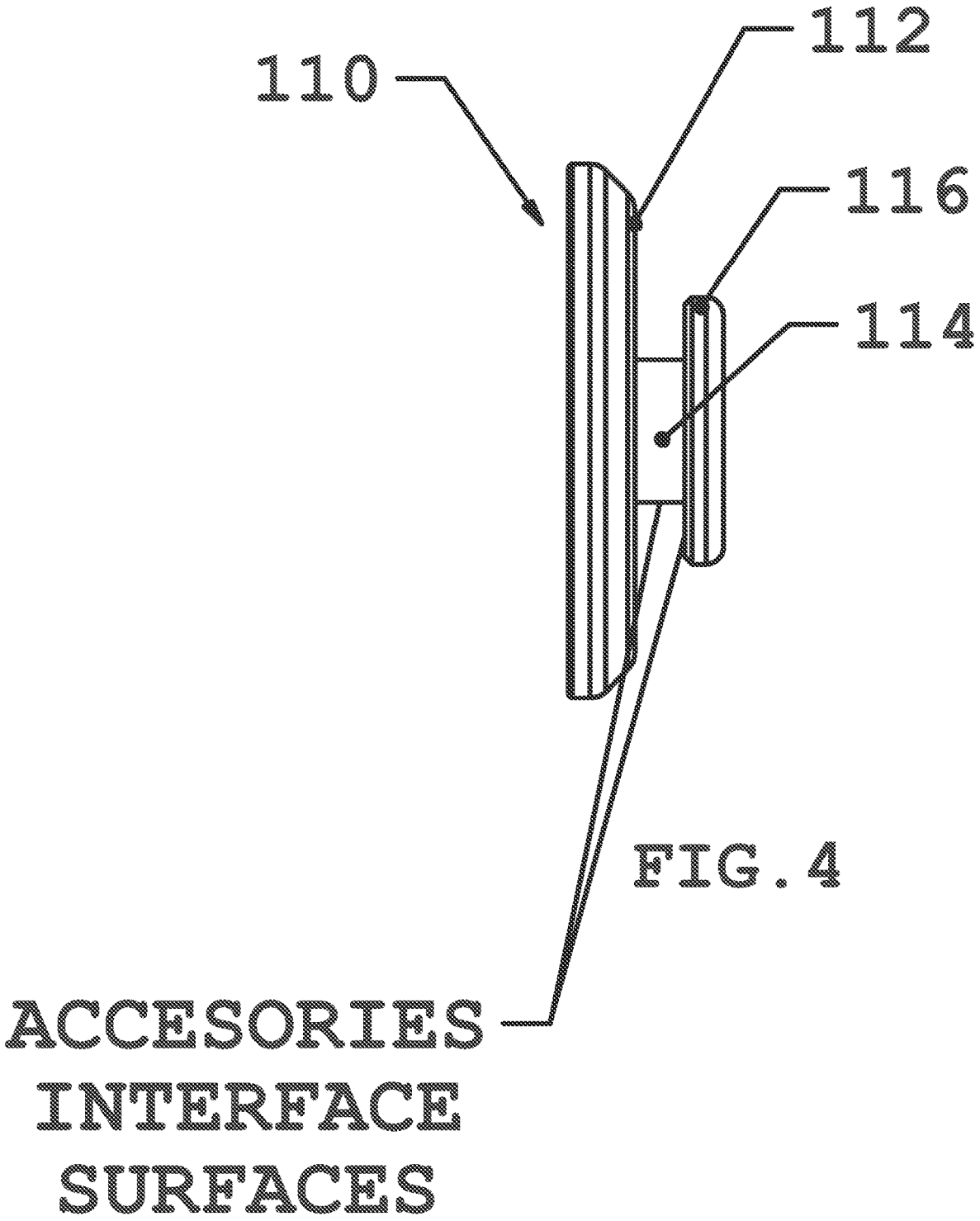
FIG. 4 is a side view of the mounting cleat portion appearing in FIG. 3.
Figure 5:
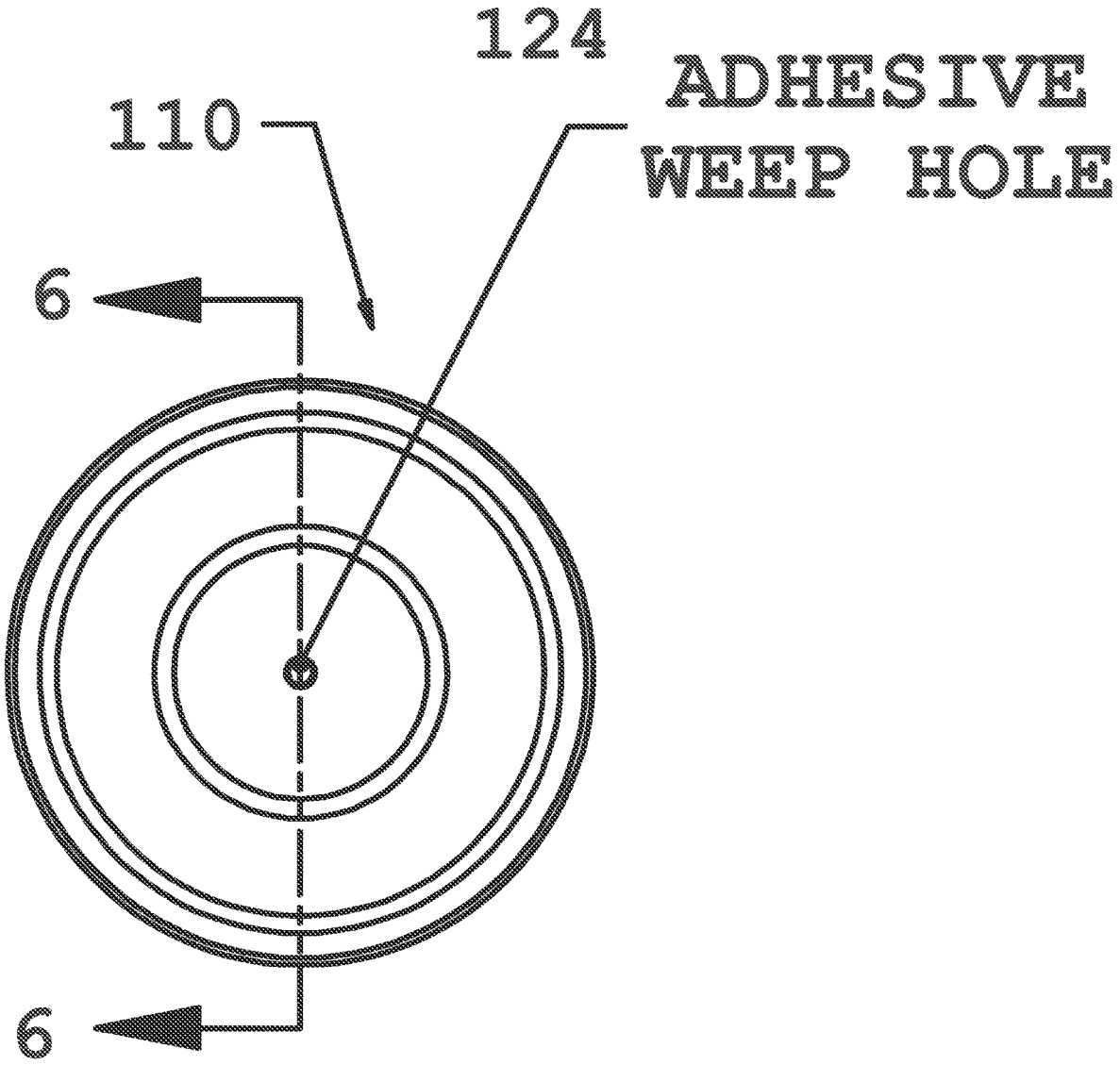
FIG. 5 is a top view of the mounting cleat portion appearing in FIG. 3.
Figure 5A:
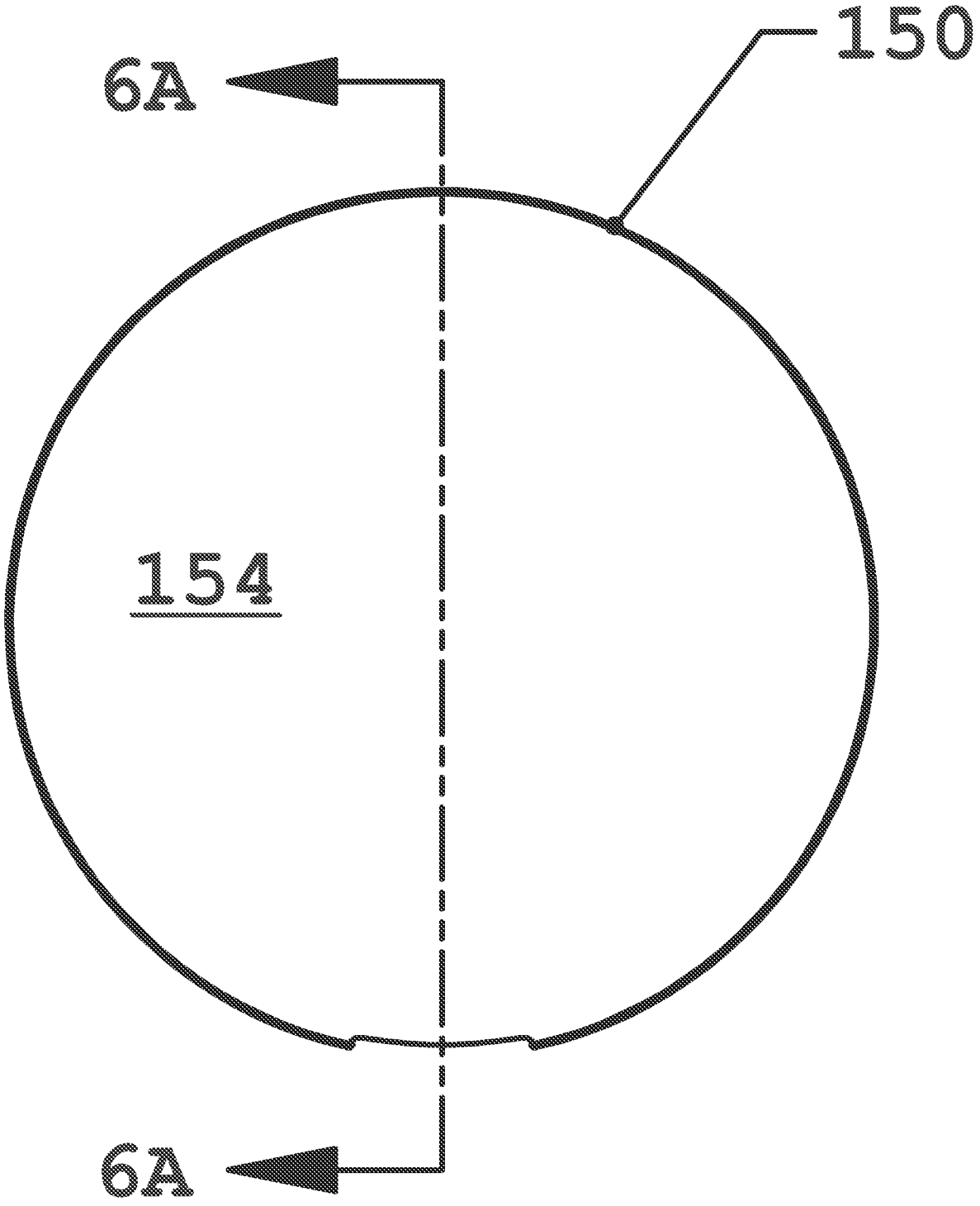
FIG. 5A is a top view of the cover portion of the helmet mount system appearing in FIG. 1.
Figure 6:
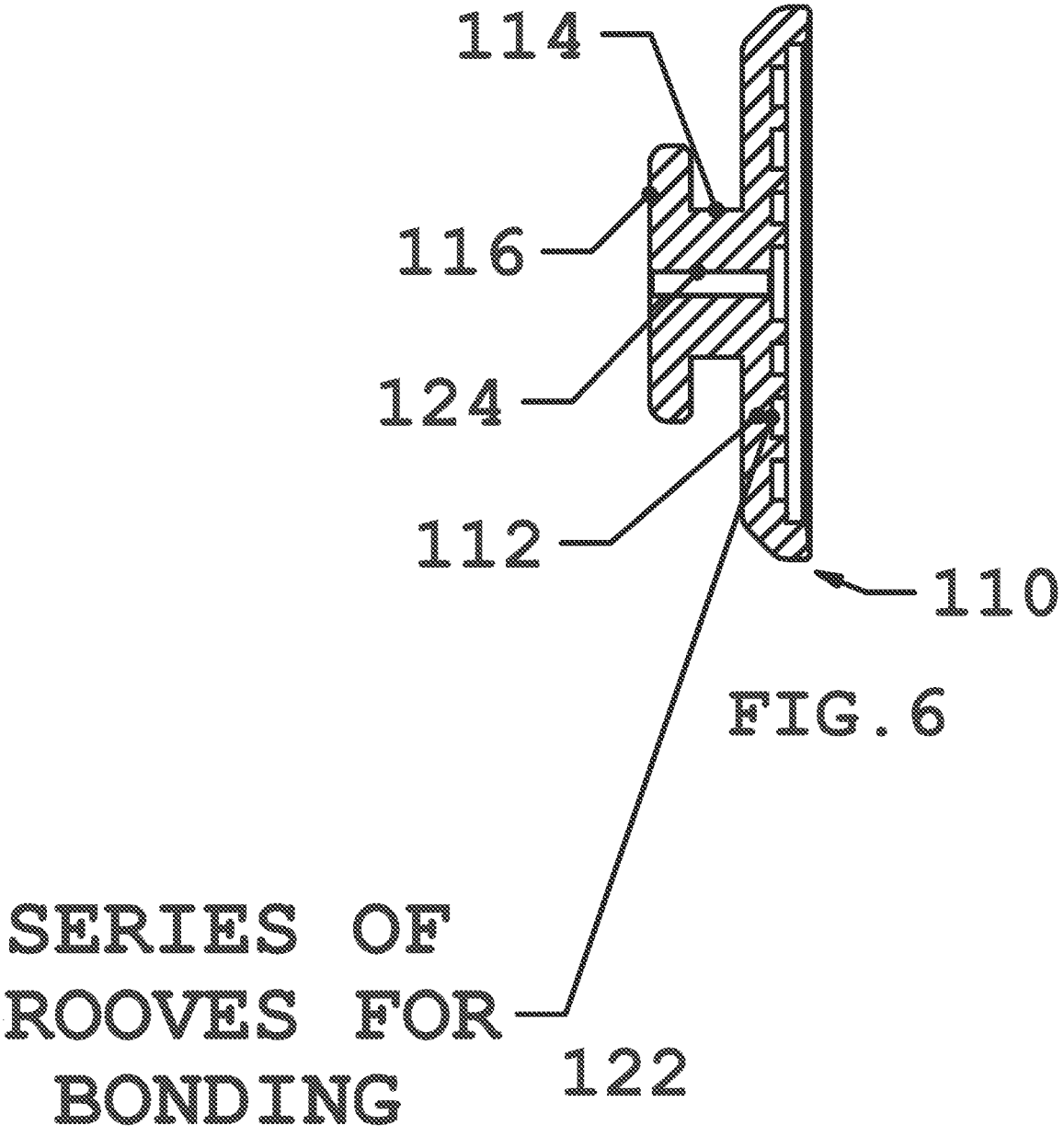
FIG. 6 is a side cross-sectional view taken along the lines 6-6 of the mounting cleat portion appearing in FIG. 3.
Figure 6A:
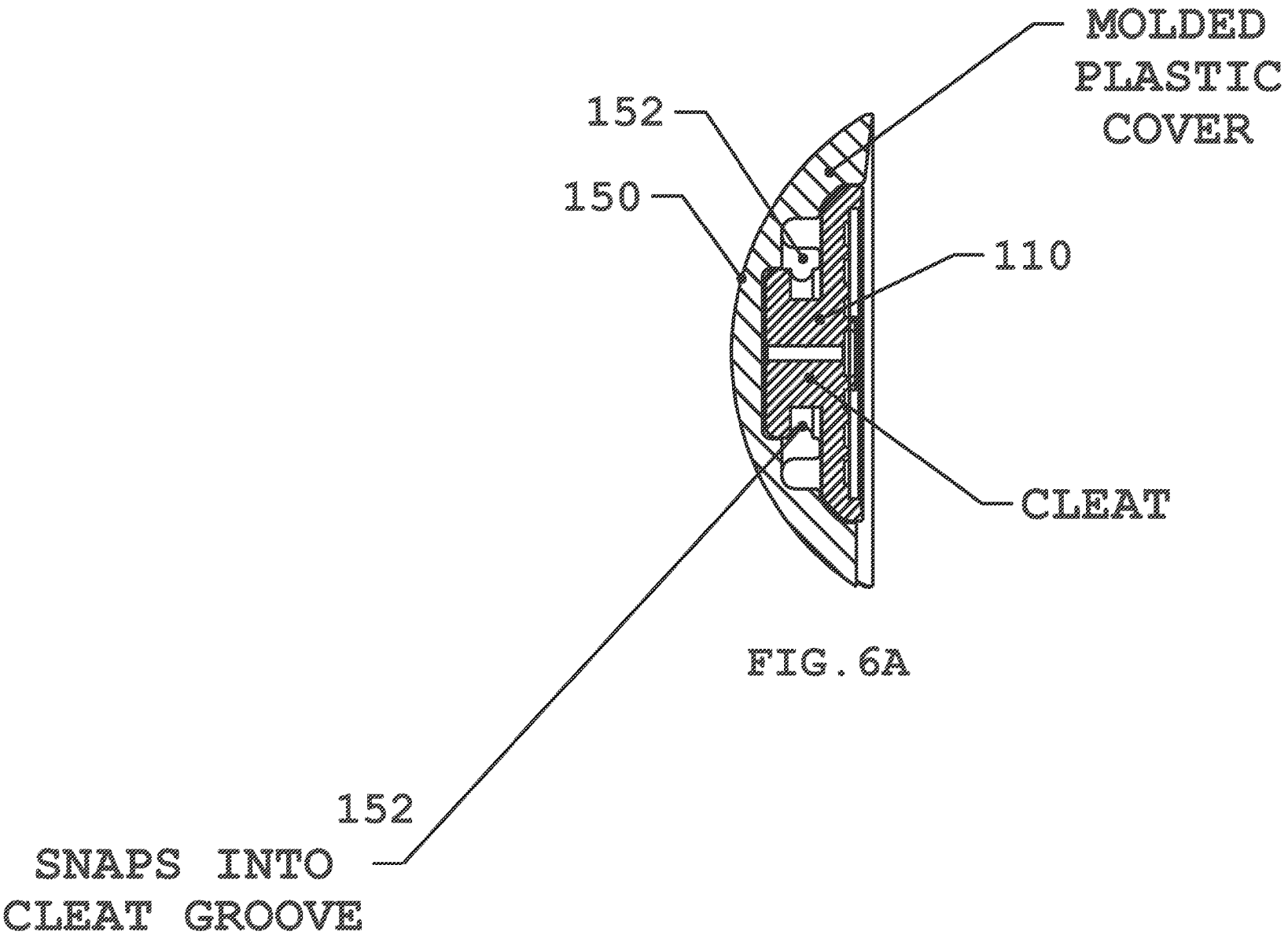
FIG. 6A is a side cross-sectional view taken along the lines 6A-6A of the cover portion coupled with the mounting cleat portion.

FIGS. 3 and 4 are enlarged bottom and side views, respectively, of the cleat 110. FIG. 5 is a top view of the cleat 110 and FIG. 5A is a top view of the cleat 110 with the cover 150 attached. FIG. 6 is a side cross sectional view taken along the lines 6-6 appearing in FIG. 5 and FIG. 6A is a side cross sectional view taken along the lines 6A-6A appearing in FIG. 5A. Although the exemplary cleats 110 are illustrated herein as having a generally circular peripheral shape, it will be recognized that the peripheral shape may be any desired shape, including three-sided, four-sided (e.g., square), five-sided, six-sided (e.g., regular hexagonal), or any other geometric shape.

In certain embodiments, the cleat 110 is formed of a metal, such as aluminum, and is preferably hard coat anodized aluminum. In certain embodiments, the cleat is plated with a plating material which matches the color of the helmet. The cleat 110 includes a flange or base 112 having a post 114 extending therefrom in a direction away from the helmet when the cleat 110 is attached to the helmet in its operational position. The post 114 has an enlarged diameter head 116 at its distal end, opposite the base 112. The base 112, post 114, and head 116 cooperate to define an interface or fastener for attaching an accessory device, mounting apparatus or bracket, or the like, to the associated helmet 100.

The base member 112 further includes a raised annular wall or lip 118 at the outer peripheral edge of the base 112. The annular wall or lip 118 extends generally in a direction toward the helmet when the cleat 110 is attached to the helmet in its operational position. The base 112 and the lip 118 cooperate to define a cavity 120 which is filled with the adhesive 130 used to secure the cleat 110 to the helmet 100.

In certain embodiments, the helmet-facing surface of the base 112 includes one or more annular grooves 122 for improving the bond between the cleat 110 and the helmet 100. It will be recognized that other geometric patterns besides concentric grooves may be employed to providing increased bonding surface area. In certain embodiments, a weep hole 124 extends through the post 114 between the cavity 120 and the head 116 to provide a fluid passageway for venting of air and excess adhesive 130 from the cavity 120 when the cleat 110 is adhesively bonded to the helmet 100.

Figure 7:
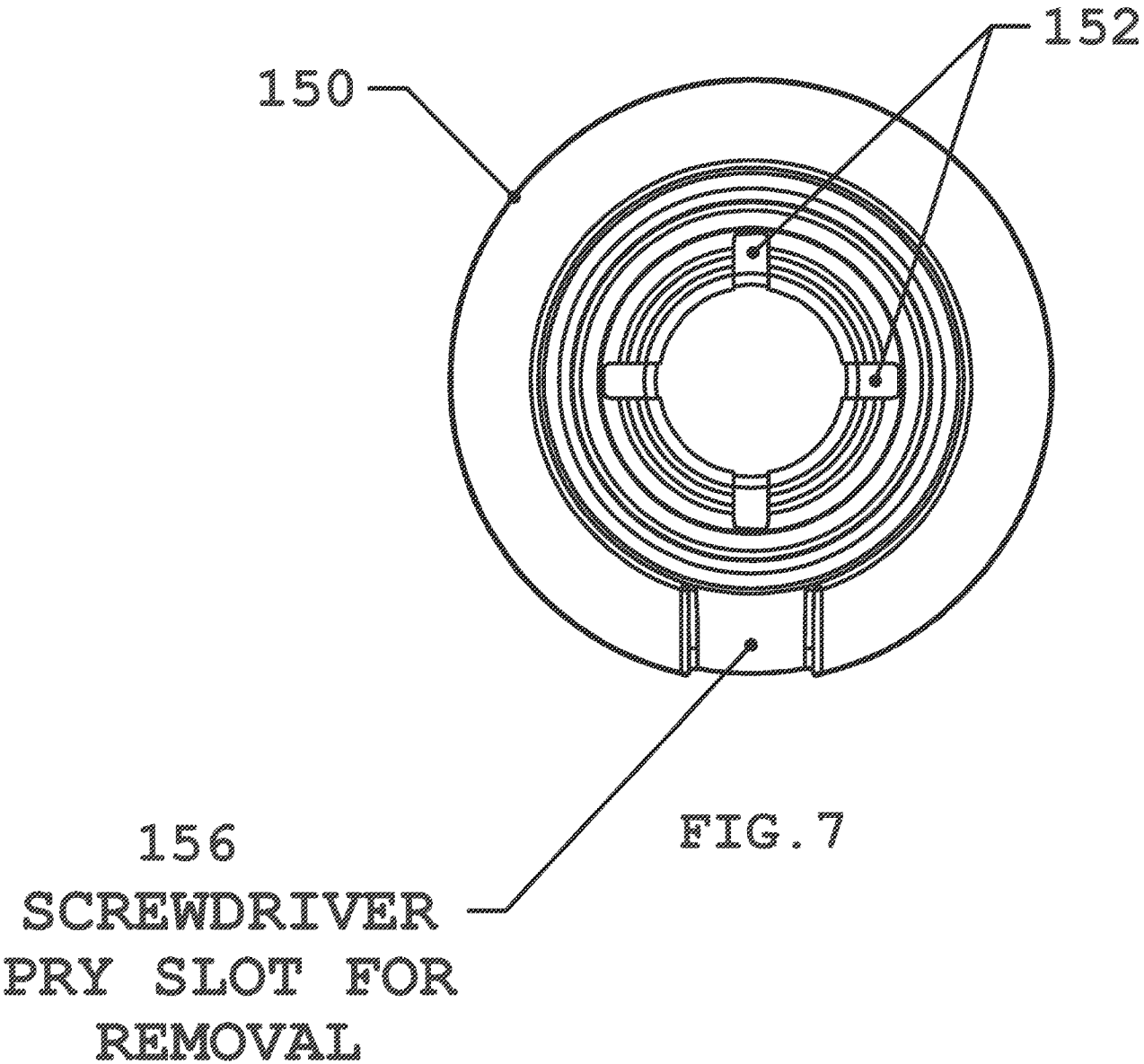
FIG. 7 is a bottom view of the cover portion of the helmet mount system appearing in FIG. 1.
Figure 8:
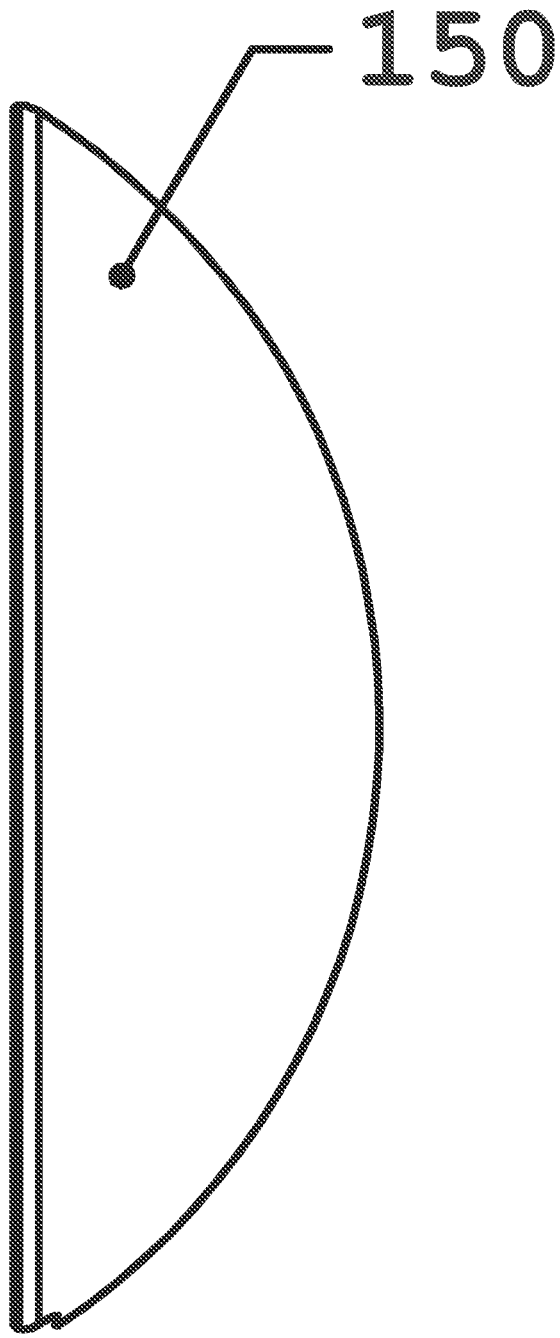
FIG. 8 is a side view of the cover portion appearing in FIG. 7.
Figure 9:
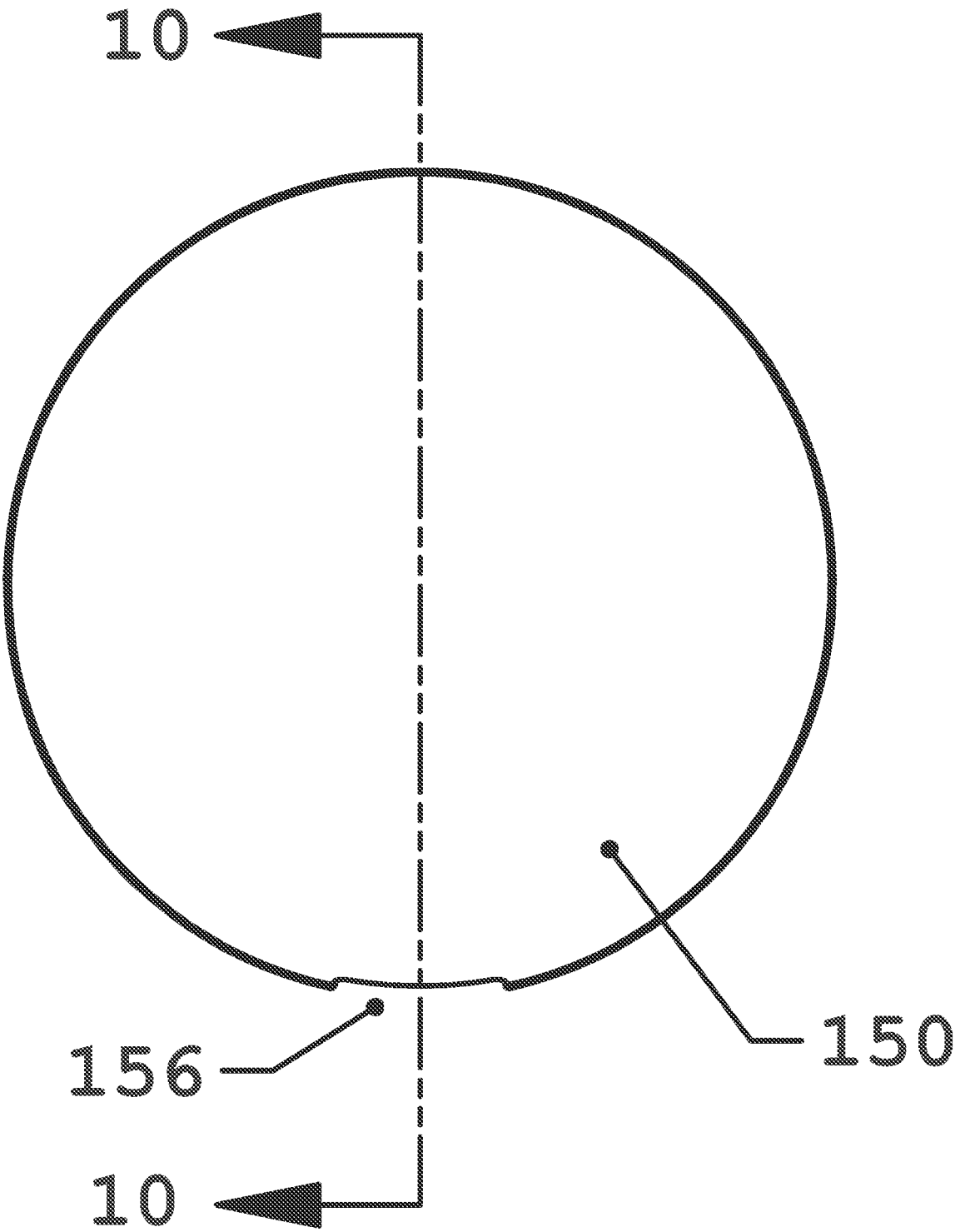
FIG. 9 is a top view of the cover portion of the cover appearing in FIG. 7.
Figure 10:
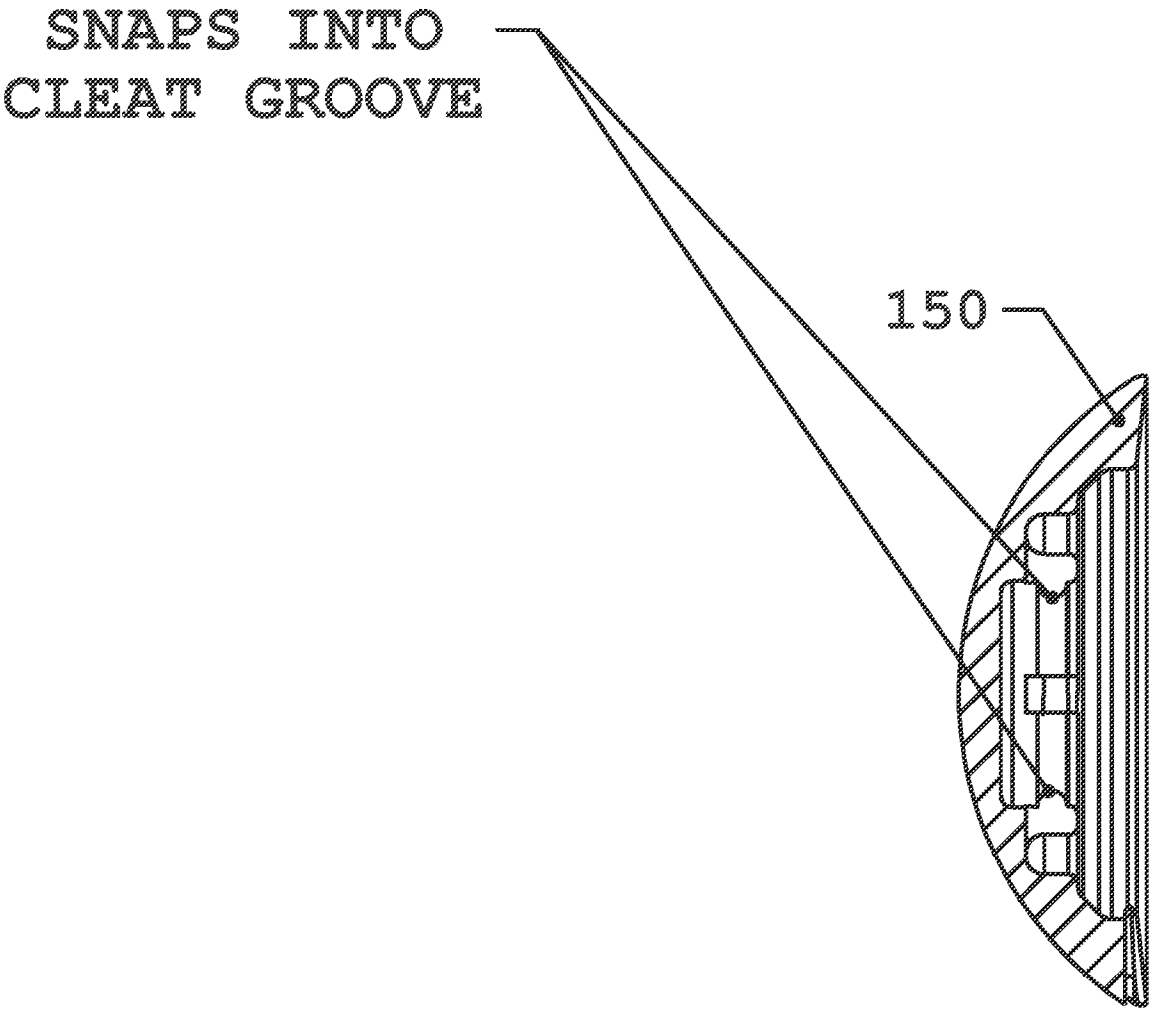
FIG. 10 is a side cross-sectional view taken along the lines 10-10 of the cover portion appearing in FIG. 9.

In certain embodiments, a cover 150 is removably attachable to the cleat 110 when the cleat 110 is not in use for attaching a helmet mounted-accessory device or mounting hardware. FIG. 7 is a bottom view of an exemplary cover 150. FIGS. 8 and 9 are side and top views, respectively, thereof. FIG. 10 is a side cross-sectional view taken along the lines 10-10 appearing in FIG. 9.

The cover 150 defines a receptacle complementary in profile to the cleat 110 and includes resilient fastener elements 152 for removable attachment to the cleat 110 e.g., via a snap fit engagement with the annular channel defined by the base 112, post 114, and head 116. The outer surface 154 of the cover 150 is preferably smooth and rounded to prevent snags when the helmet is worn in areas with brush or other snag hazards. In certain embodiments, a notch 156 is provided in the cover to facilitate removal of the cover with a tool, such as a screwdriver or other flat-edged pry tool, or the like.

In certain embodiments, the dimensions of the cleat 110, such as the height, diameter, and thickness of the base 112, post 214, head 216, etc., may be standardized to define a common interface standard that multiple manufactures can design to.

Figure 11:
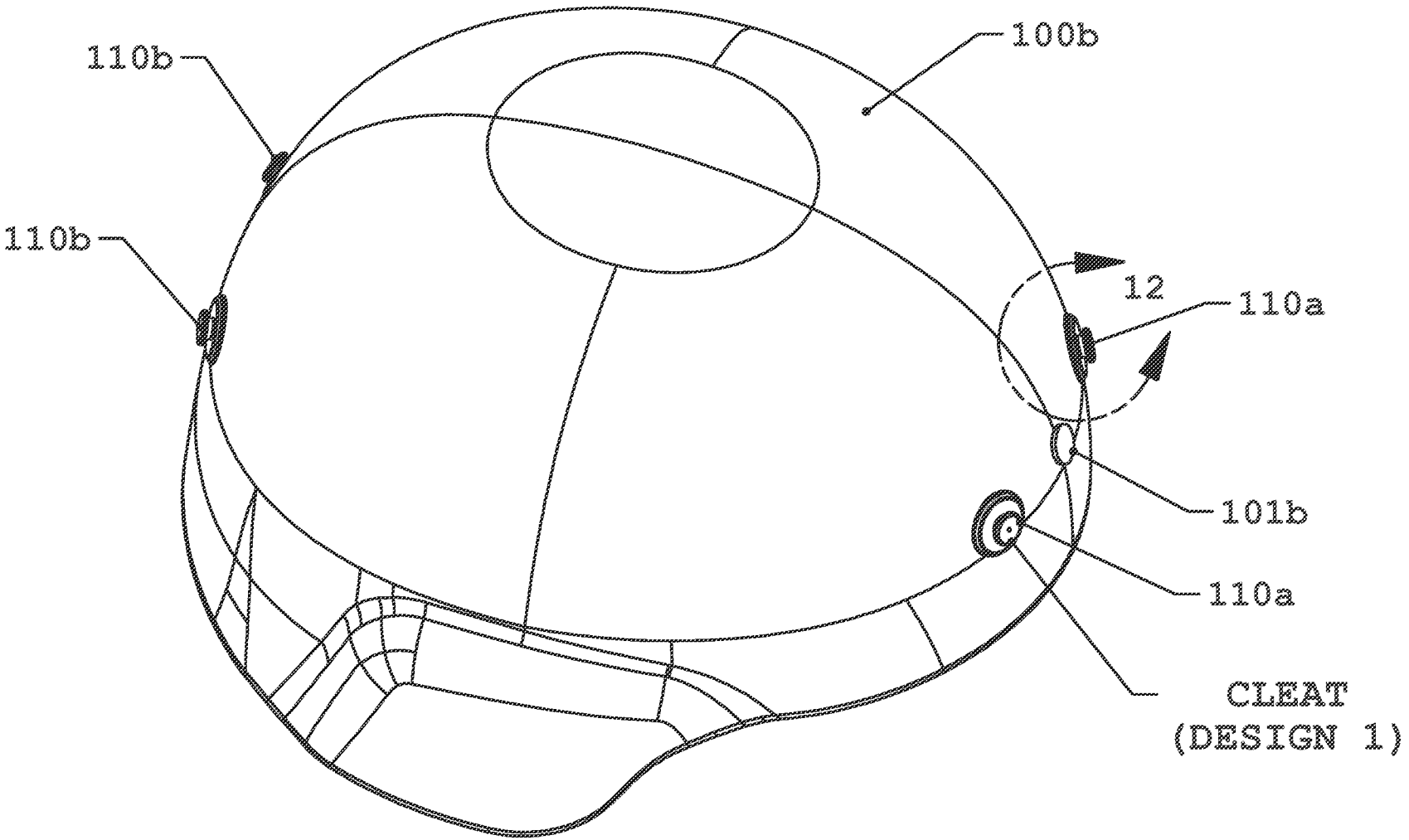
FIG. 11 is an isometric view of a helmet mount system according to a second exemplary embodiment.
Figure 12:
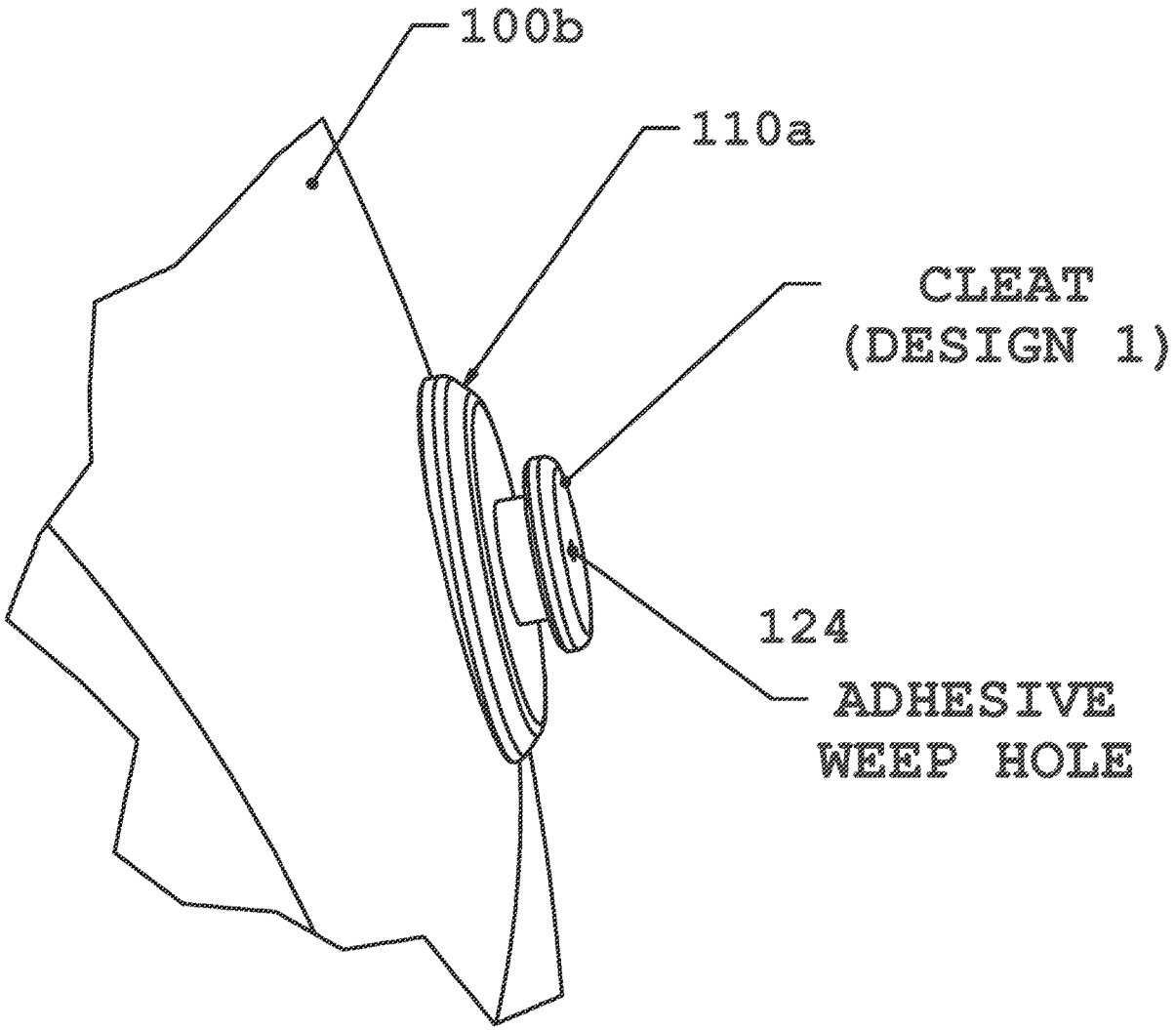
FIG. 12 is a fragmentary view of the embodiment appearing in FIG. 11.

FIG. 11 shows a second helmet configuration wherein a helmet 100*b* includes four cleats 110 adhesively attached to the helmet 100*b*. FIG. 12 is an enlarged view of the region 8 appearing in FIG. 11. In the configuration appearing in FIG. 11, there are two cleats 110*a* disposed on the front portion of the helmet 100*b* and two cleats 110*b* disposed on the rear portion of the helmet 100*b*. The two cleats 110*a* are spaced apart and are on opposite sides of the median plane of the helmet 100. Likewise, the two cleats 110*b* are spaced apart and are on opposite sides of the median plane of the helmet 100*b*. In certain embodiments, the configuration appearing in FIG. 11 is adapted for attaching a forward shroud (e.g., for attaching a mounting system for a night vision device) and a rear battery compartment dock.

Although an advantage of the present invention is that it avoids the need to drill holes in the helmet shell, it will be recognized that the present invention may also be employed with existing helmets which may have one or more pre-drilled holes. In such instances, such pre-drilled holes should have a ballistic grade screw 101*b* screwed into the existing screw hole.

In certain embodiments, the cleat dimensions, e.g., as described above, and the cleat spacing may be standardized to define a common interface standard that multiple manufactures can design to.

Figure 13:
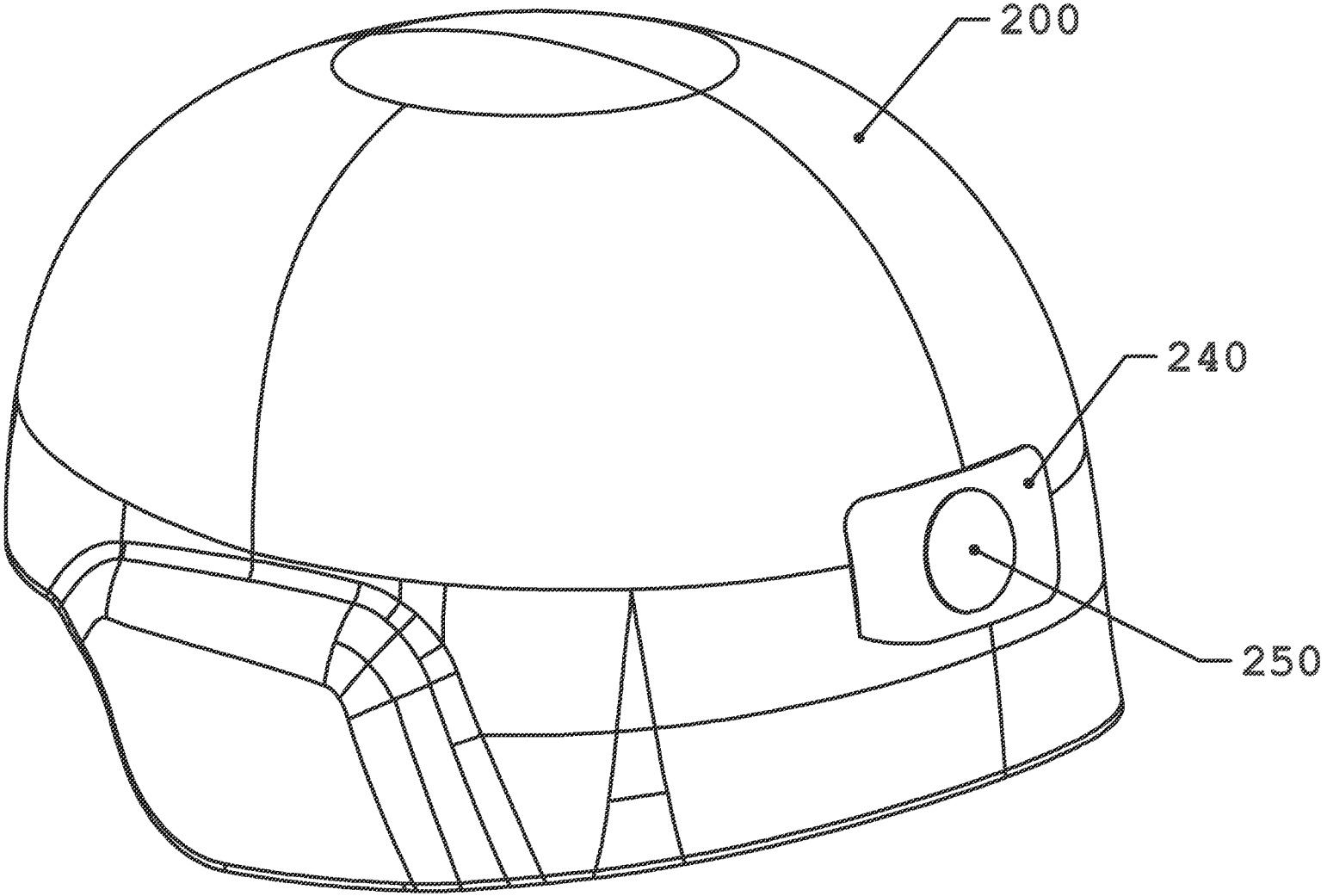
FIG. 13 is an isometric view of a helmet mount system according to a third exemplary embodiment.

Referring now to FIG. 13, an isometric view of an exemplary helmet 200 (e.g., which may be as described above) appears, having one mounting cleat 210 in accordance with this disclosure attached to the rear and central portion of the helmet. It will be recognized that the illustrated embodiment is exemplary only and that the embodiment of FIG. 1 can be adapted for positioning at any one or more locations on the helmet 200, including, for example, the front, side(s), top, and elsewhere.

Figure 14:
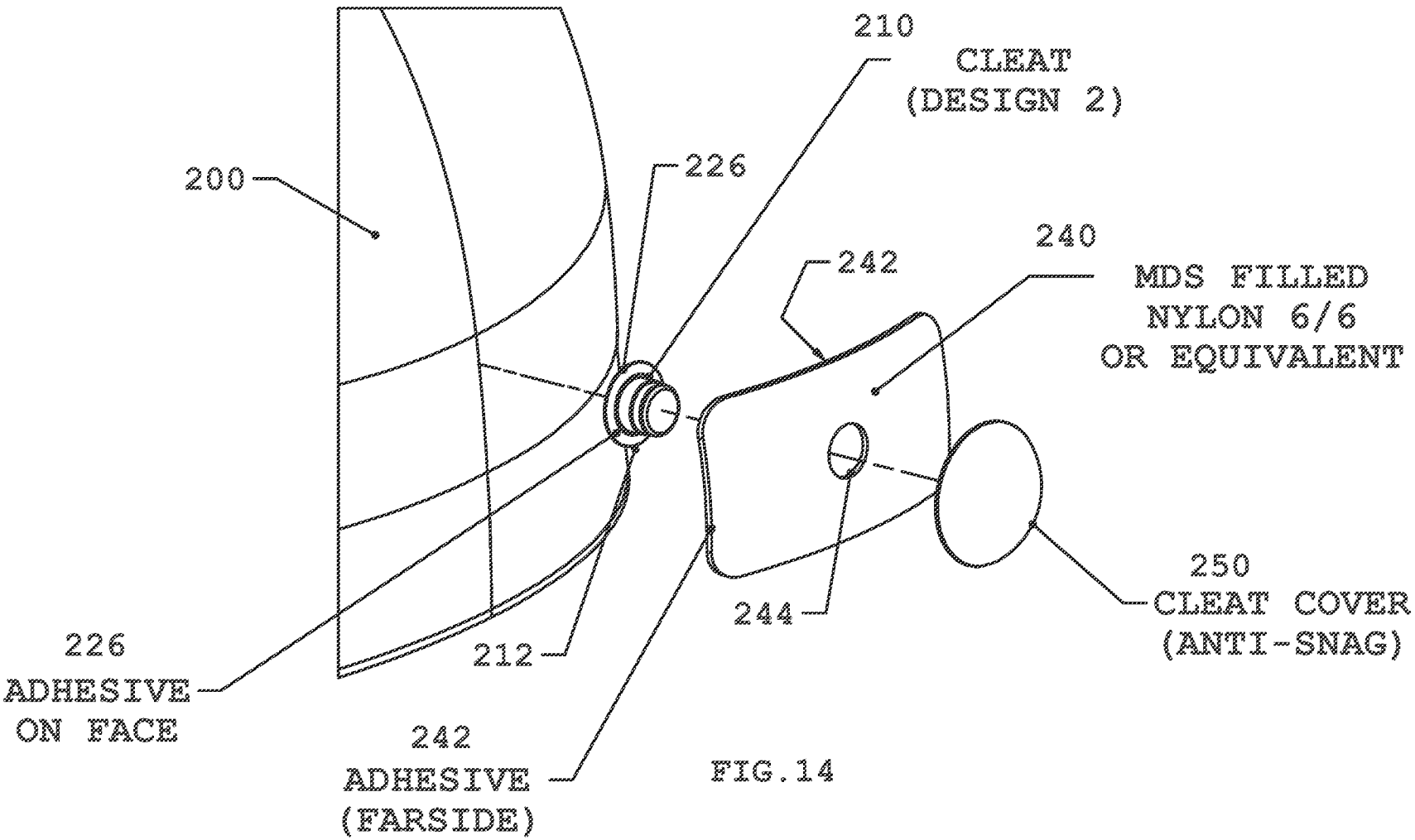
FIG. 14 is a fragmentary exploded view of the embodiment appearing in FIG. 13.

FIG. 14 is a fragmentary, exploded view of the helmet and cleat system appearing in FIG. 13. The cleat system includes a cleat 210, which is secured to the helmet surface with an adhesive-backed securing member 240, and may further include a cover 250.

Figure 15:
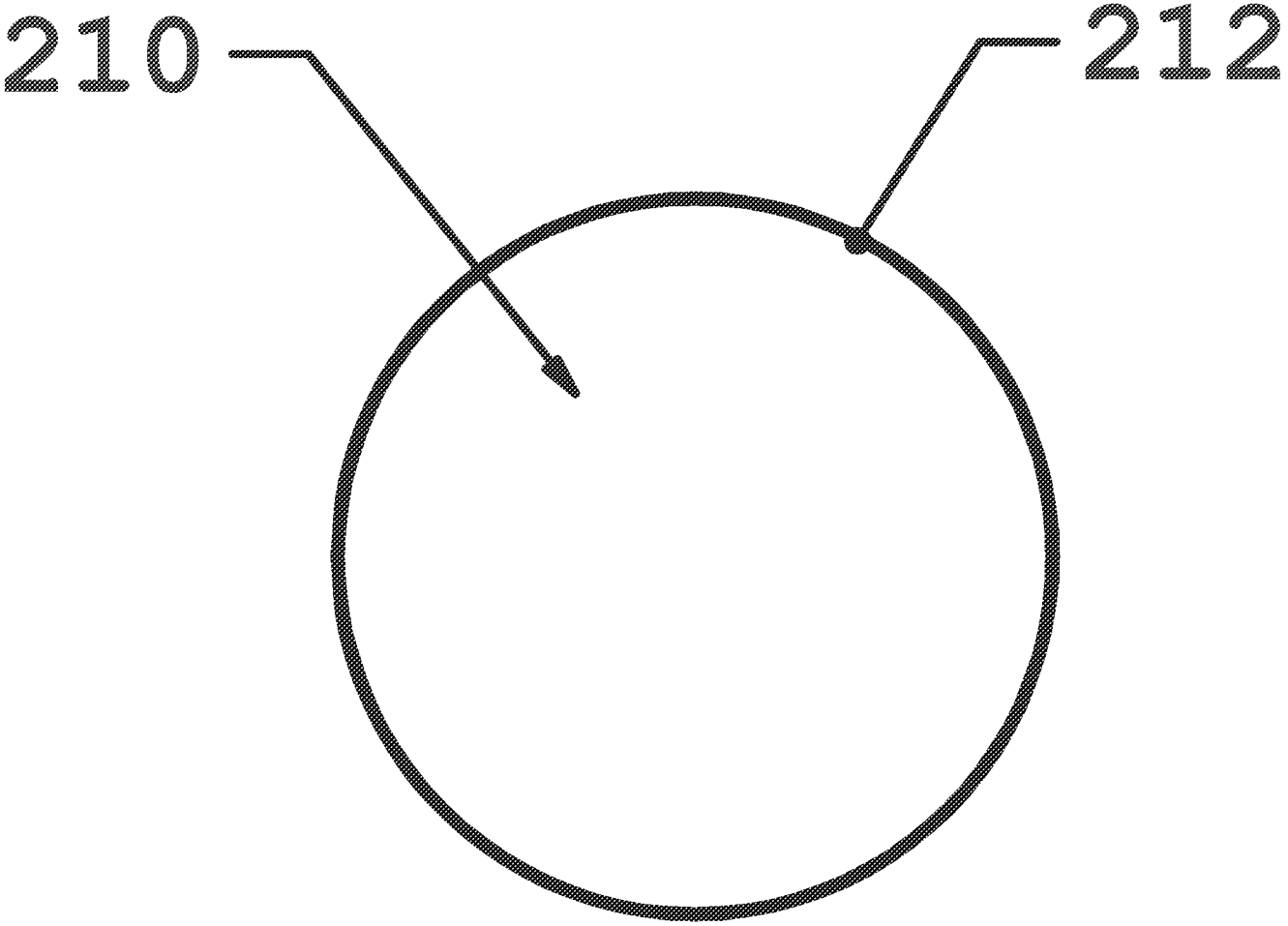
FIG. 15 is a top view of the cover portion of the embodiment appearing in FIG. 13.
Figure 16:
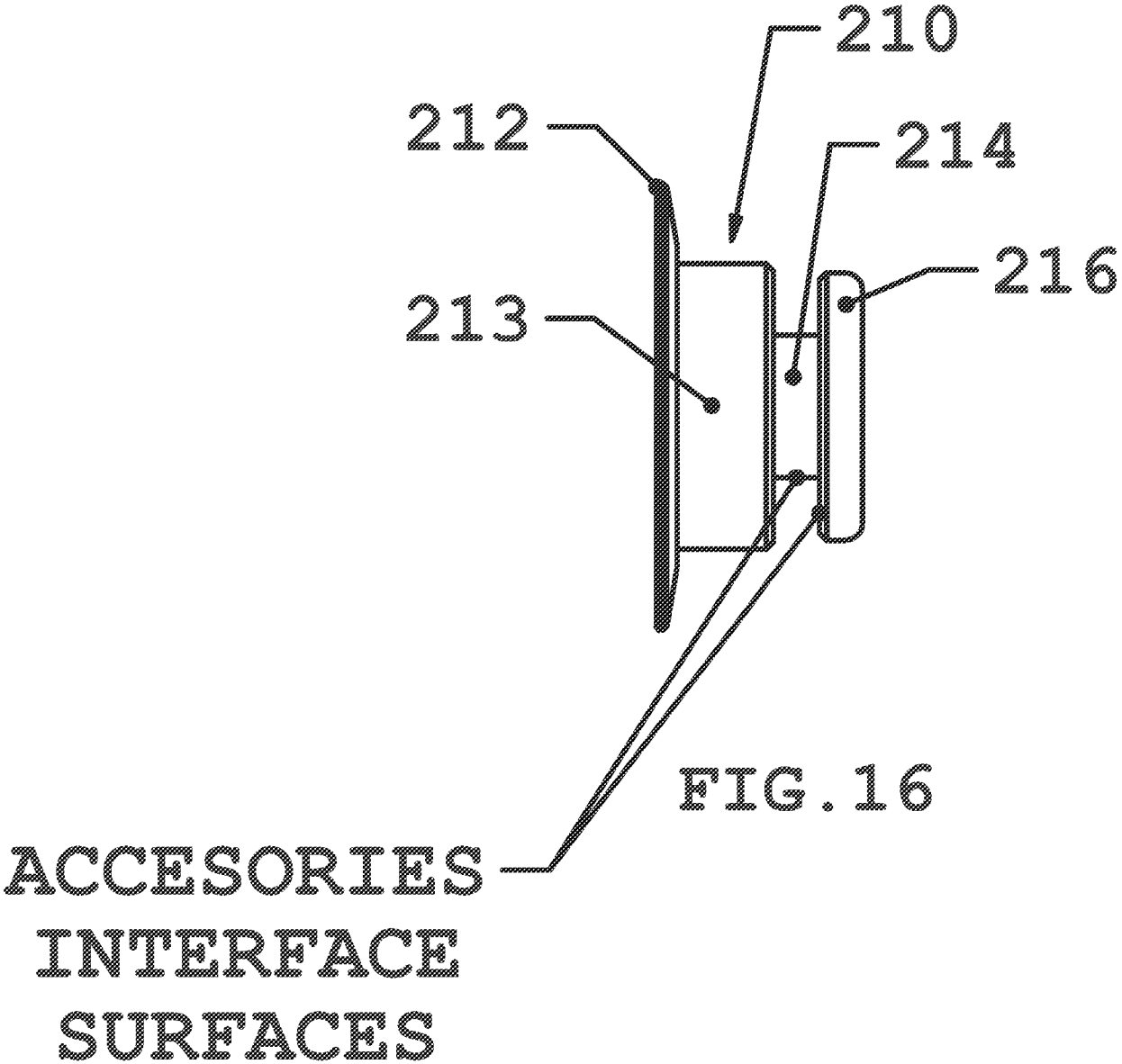
FIG. 16 is a side view of the mounting cleat portion of the embodiment appearing in FIG. 13.
Figure 17:
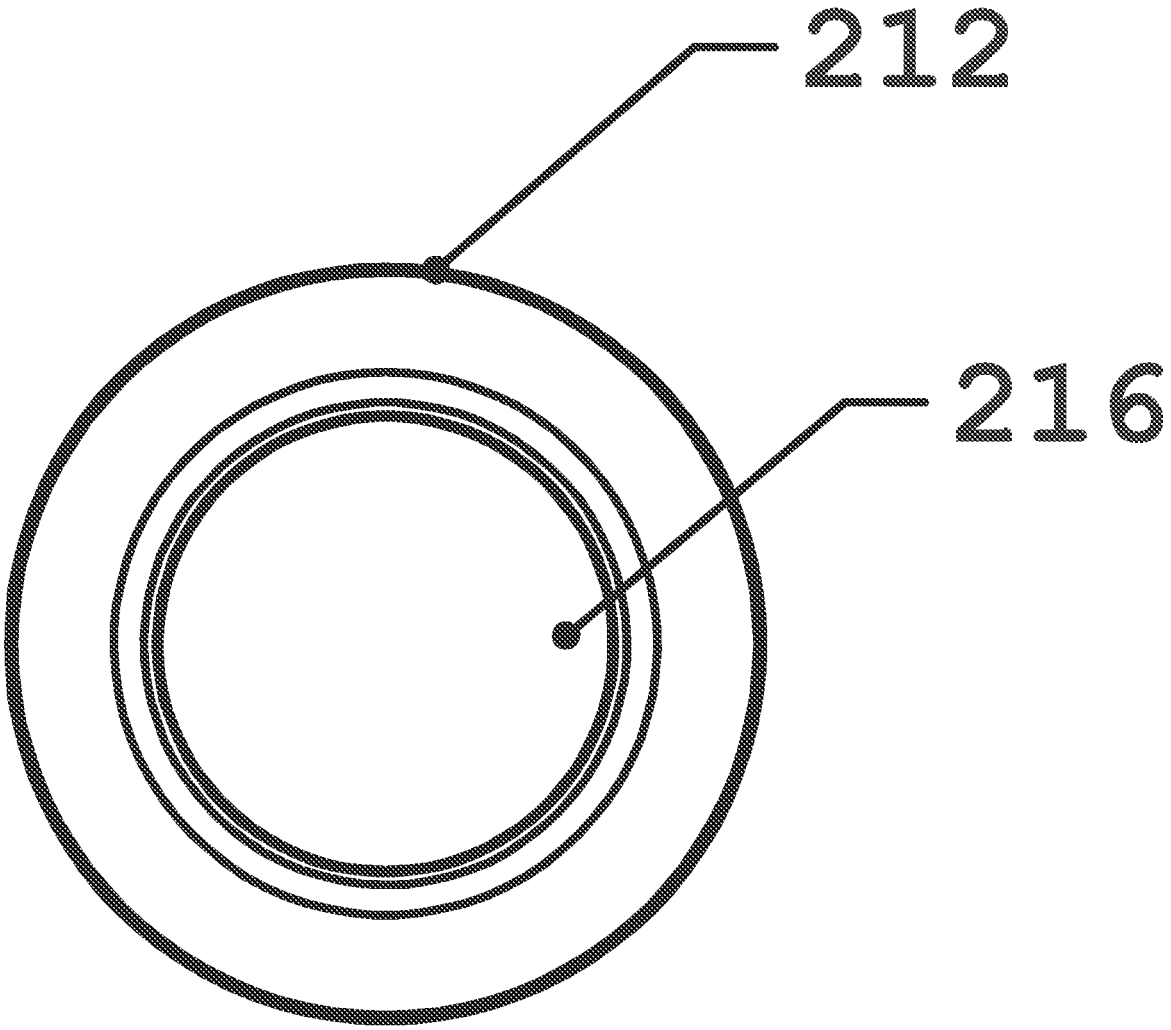
FIG. 17 is a top view of the mounting cleat portion of the embodiment appearing in FIG. 13.

FIGS. 15 and 16 are enlarged bottom and side views, respectively, of the cleat 210. FIG. 17 is a top view of the cleat 210.

In certain embodiments, the cleat 210 is formed of a metal, preferably aluminum. The cleat 210 includes a flange 212 having a base 213 extending therefrom in a direction away from the helmet when the cleat 210 is attached to the helmet in its operational position. A post 214, in turn, extends from the base in a direction away from the helmet when the cleat 210 is attached to the helmet in its operational position. The post 214 has an enlarged diameter head 216 at its distal end, opposite the base 213. The base 213, post 214, and head 216 cooperate to define an interface or fastener for attaching an accessory device to the associated helmet 200.

The illustrated embodiment depicts a single cleat 210 secured with the adhesive-backed securing member 240 at a single, exemplary position on the helmet 200. It will be recognized, however, that any number of cleats 210 may be secured in the same manner at any desired position(s) on the helmet 200.

The adhesive-backed securing member 240 is formed of a sheet material, which may be a molded or extruded polymer material. In certain embodiments, the material is a nylon material, and in preferred embodiments, is formed of a molybdenum disulfide (MDS) filled nylon 6/6 material. The adhesive-backed securing member 240 has an adhesive layer 242 disposed on the helmet facing surface thereof. An aperture 244 is formed in the adhesive-backed securing member 240. The cleat 210 extends through the aperture 244 and the adhesive-backed securing member 240 is adhesively bonded to the surface of the helmet. The adhesive-backed securing member 240 engages the flange 212 to secure the cleat 210 to the helmet 200. In certain embodiments, no adhesive is used between the helmet and the helmet facing surface of the cleat 210. In certain embodiments, an adhesive layer is used between the helmet and the helmet facing surface of the cleat 210. Optionally, an adhesive layer may be provided on the outward facing surface 226 of the flange 212 to enhance the adhesive bond between the flange 212 and the adhesive layer 242.

The illustrated embodiment depicts an adhesive-backed securing member 240 having a single cleat-receiving aperture 244. It will be recognized, however, that each adhesive-backed securing member 240 could alternatively have multiple (e.g., 2, 3, 4, 5, or more) apertures 244 for securing a corresponding number cleats 210 to the helmet 200. In such multiple-cleat embodiments, the spacing between the multiple apertures can be selected to provide groupings of cleats spaced in accordance with some predetermined or pre-specified spacing.

In certain embodiments, a cover 250 is provided which is removably attachable to the cleat 210 when the cleat 210 is not in use for attaching a helmet mounted-accessory device or mounting hardware. The cover 250 defines a receptacle that complementary with the shape of the cleat 210 and may include resilient members (not shown) removably engaging the cleat as described above by way of reference to the cover 150. The outer surface 254 of the cover 250 is preferably smooth and rounded to prevent snags when the helmet is worn in areas with brush or other snag hazards.

In certain embodiments, the dimensions of the cleat 210, such as the height, diameter, and thickness of the base 213, post 214, head 216, etc., may be standardized to define a common interface standard that multiple manufactures can design to.

Figure 18:
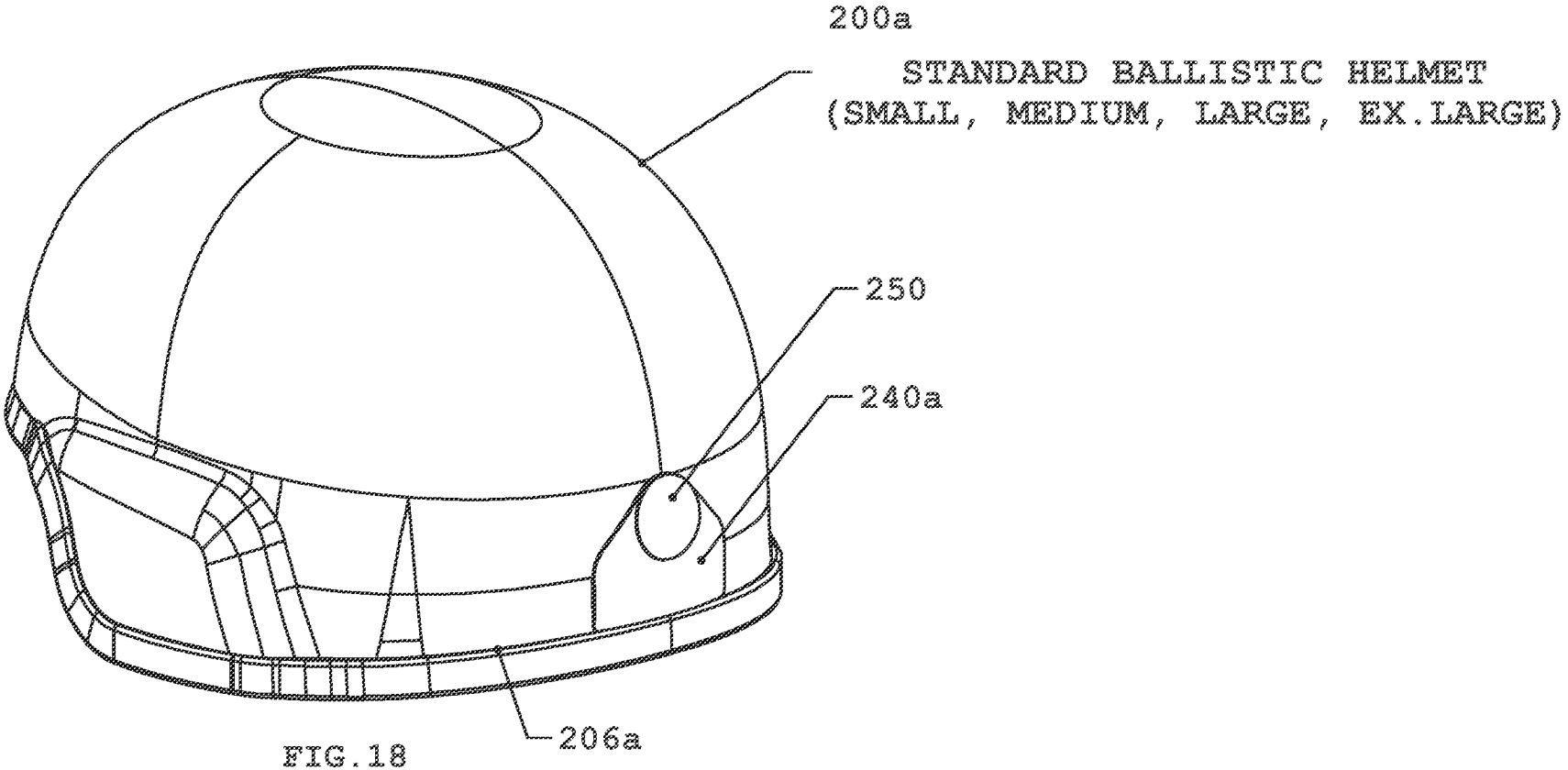
FIG. 18 is a helmet mount system according to a fourth exemplary embodiment.

Referring now to FIG. 18, an isometric view of an exemplary helmet 200*a* (e.g., which may be as described above) appears, having one mounting cleat 210 in accordance with this disclosure attached to the rear and central portion of the helmet. It will be recognized that the illustrated embodiment is exemplary only and that the embodiment of FIG. 1 can be adapted for positioning at any one or more locations on the helmet 200*a*, including, for example, the front, side(s), top, and elsewhere.

Figure 19:
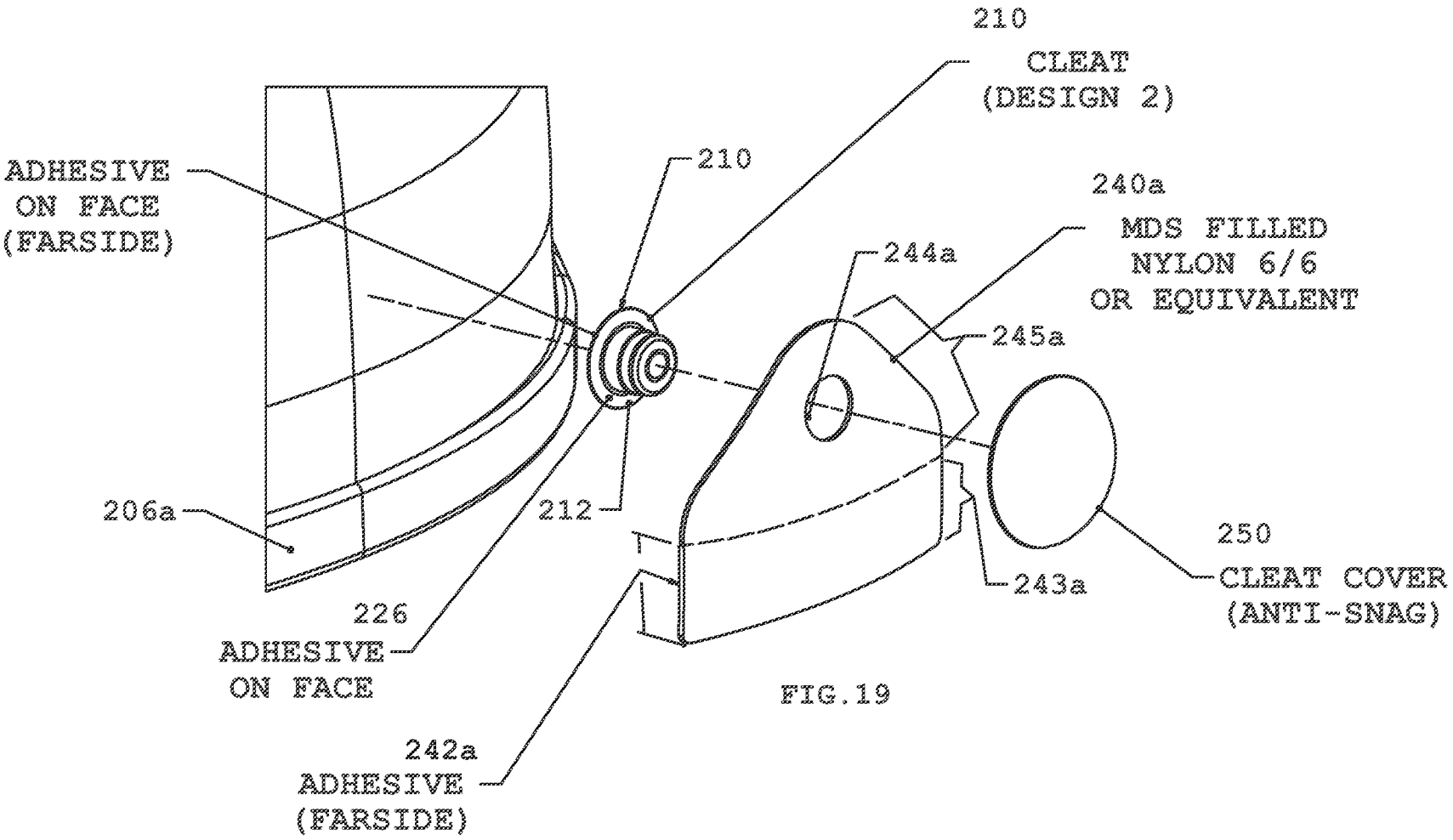
FIG. 19 is a fragmentary exploded view of the embodiment appearing in FIG. 18.

FIG. 19 is a fragmentary, exploded view of the helmet and cleat system appearing in FIG. 18. The cleat system includes a cleat 210, which is secured to the helmet surface with an adhesive-backed securing member 240*a*, and may further include a cover 250.

The cleat 210 and cover 250 appearing in FIGS. 18 and 19 are as described above by way of reference to FIGS. 13-17.

The adhesive-backed securing member 240*a* is formed of a sheet material, which may be a molded or extruded polymer material. In certain embodiments, the material is a nylon material, and in preferred embodiments, is formed of MDS filled nylon 6/6. The adhesive-backed securing member 240*a* has an adhesive layer 242*a* disposed on the helmet facing surface thereof.

In certain embodiments, the adhesive layer 242*a* is applied to a lower portion 243*a* of the adhesive-backed securing member and an upper portion 245*a* of the adhesive-backed securing member which carries the cleat 210 is adhesive-free. In such embodiments, upwards pressure from a cinched strap (not shown) attached to the cleat 210 (for example, a strap extending between the cleat 210 and a night vision mounting system (not shown) attached to the front of the helmet) would tend to flatten the upper portion 245*a* and the cleat 210 against the helmet.

Alternatively, in certain embodiments, the adhesive layer 242*a* is applied to the entire helmet-facing surface of the adhesive-backed securing member 240*a*.

The illustrated embodiment depicts a single cleat 210 secured with the adhesive-backed securing member 240*a* at a single, exemplary position on the helmet 200*a*. It will be recognized, however, that any number of cleats 210 may be secured in the same manner at any desired position(s) on the helmet 200*a*.

An aperture 244*a* is formed in the adhesive-backed securing member 240*a*. The cleat 210 extends through the aperture 244*a* and the adhesive-backed securing member 240*a* secures the flange 212 to surface of the helmet 200*a*. In certain embodiments, no adhesive is used between the helmet and the helmet facing surface of the cleat 210. In certain embodiments, an adhesive layer is used between the helmet and the helmet facing surface of the cleat 210.

In embodiments wherein the adhesive layer 242*a* is confined to the lower portion 243*a*, an adhesive layer is provided on the outward facing surface 226 of the flange 212 to secure the cleat 210 to the adhesive-backed securing member 240*a*. In embodiments wherein the adhesive layer 242*a* is applied to the entire helmet-facing surface of the adhesive-backed securing member 240*a*, the use of an adhesive on the outward facing surface 226 of the flange 212 is optional.

The illustrated embodiment depicts an adhesive-backed securing member 240*a* having a single cleat-receiving aperture 244*a*. It will be recognized, however, that each adhesive-backed securing member 240*a* could alternatively have multiple (e.g., 2, 3, 4, 5, or more) apertures 244*a* for securing a corresponding number cleats 210 to the helmet 200*a*. In such multiple-cleat embodiments, the spacing between the multiple apertures can be selected to provide groupings of cleats spaced in accordance with some predetermined or pre-specified spacing.

In certain embodiments, a cover 250 is provided which is removably attachable to the cleat 210 when the cleat 210 is not in use for attaching a helmet mounted-accessory device or mounting hardware. The cover 250 defines a receptacle that complementary with the shape of the cleat 210 and may include resilient members (not shown) removably engaging the cleat as described above by way of reference to the cover 150. The outer surface 254 of the cover 250 is preferably smooth and rounded to prevent snags when the helmet is worn in areas with brush or other snag hazards.

In the illustrated embodiment, the adhesive-backed securing member 240*a* is a separately formed piece, and is separate from a helmet edge trim piece 206*a* which is disposed over the unfinished brim of the helmet 200*a*. In alternative embodiments, one or more adhesive-backed securing members may be as described above, except that they are integrally formed with the helmet edge trim 206*a*.

In certain embodiments, the dimensions of the cleat 210, such as the height, diameter, and thickness of the base 213, post 214, head 216, etc., may be standardized to define a common interface standard that multiple manufactures can design to.

Figure 20:
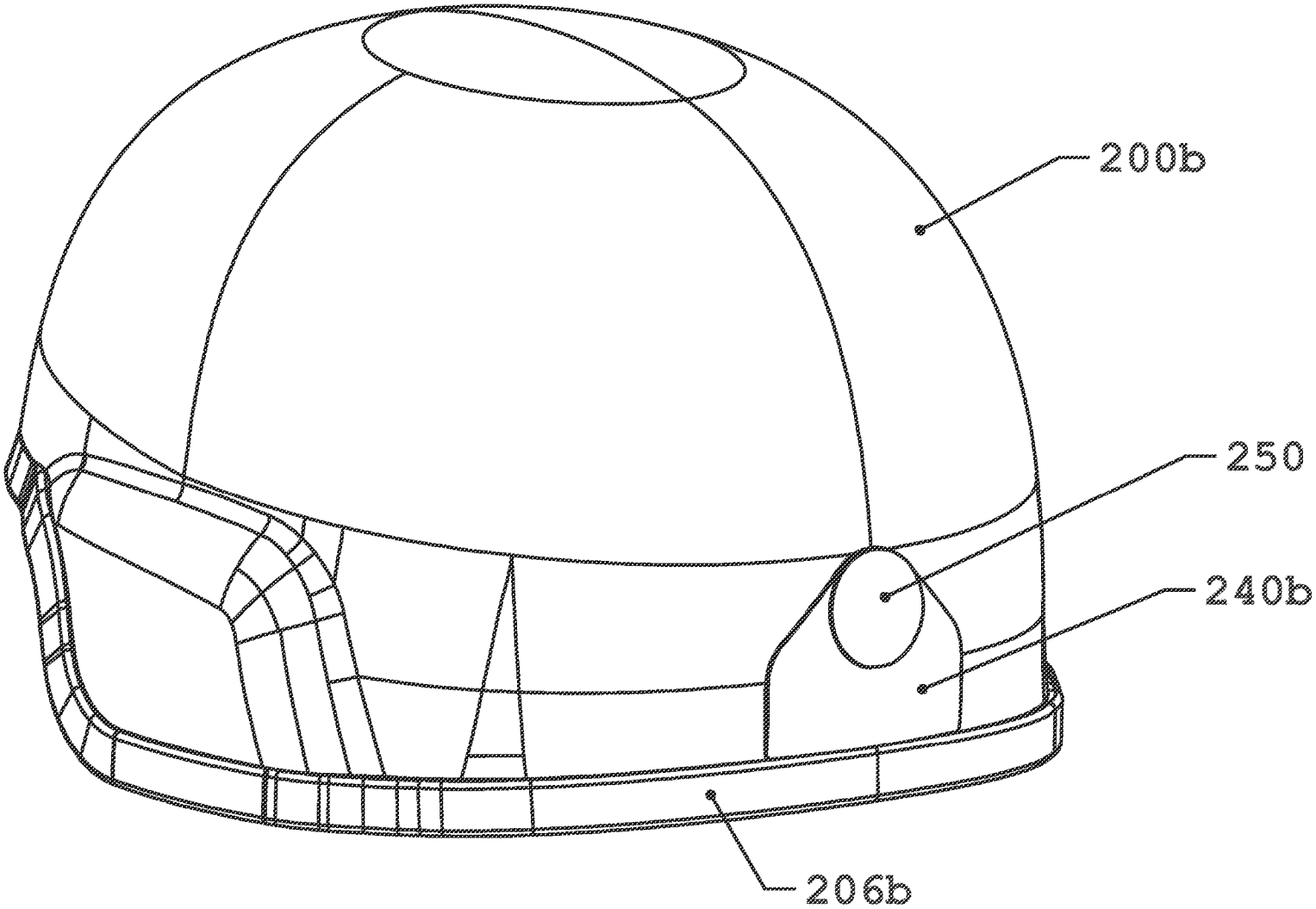
FIG. 20 is a helmet mount system according to a fifth exemplary embodiment.

Referring now to FIG. 20, an isometric view of an exemplary helmet 200*b* (e.g., which may be as described above) appears, having one mounting cleat 210 in accordance with this disclosure attached to the rear and central portion of the helmet. It will be recognized that the illustrated embodiment is exemplary only and that the embodiment of FIG. 1 can be adapted for positioning at any one or more locations on the helmet 200*b*, including, for example, the front, side(s), top, and elsewhere. The helmet 200*b* includes a shell member 202*b* having a brim 204*b*, e.g., an unfinished brim, and an edge trim piece 206*b* defining a channel 208*b* receiving the brim 204*b* to protect the brim 204*b* or otherwise to provide a finished edge.

Figure 21:
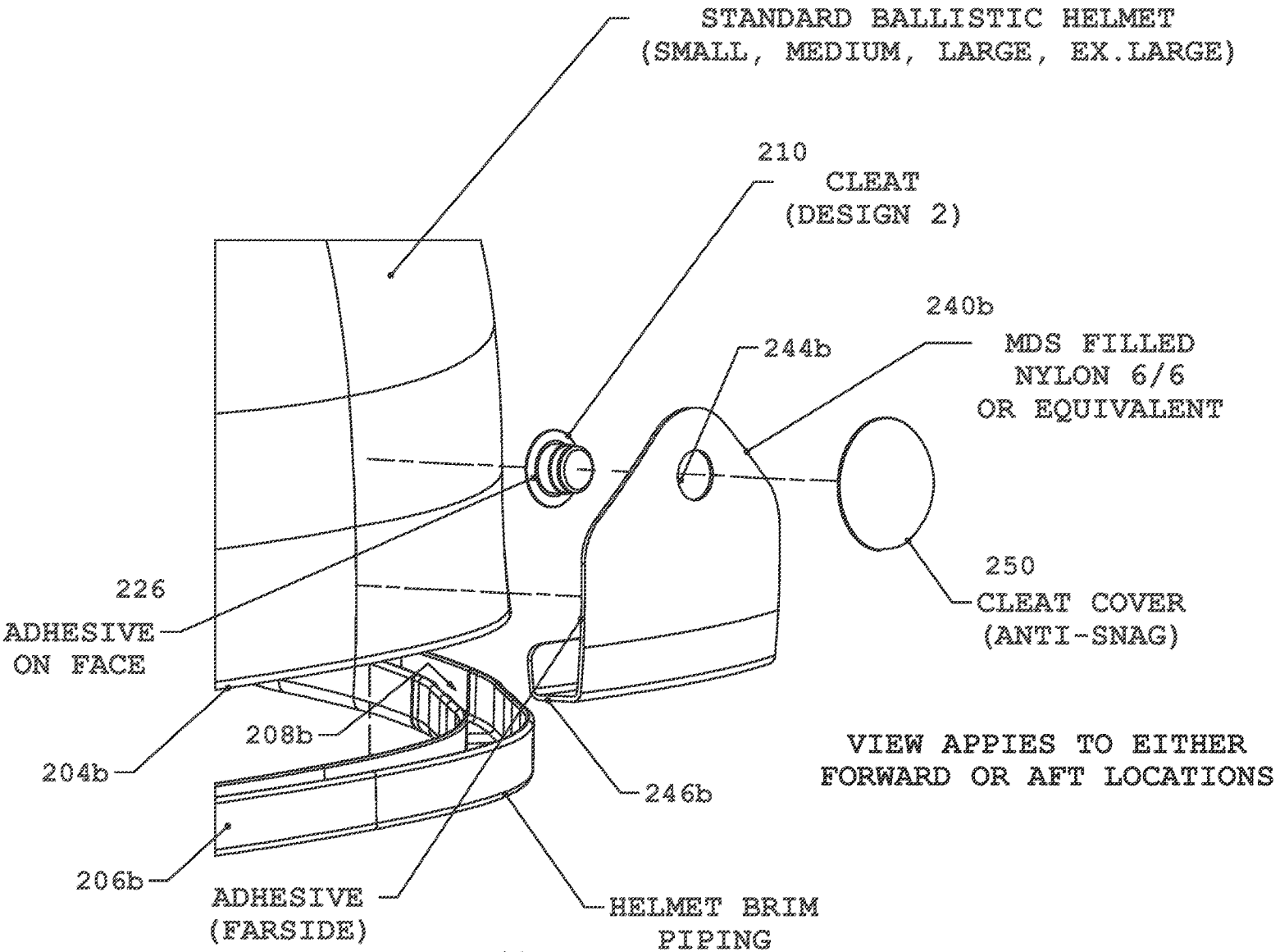
FIG. 21 is a fragmentary exploded view of the embodiment appearing in FIG. 20. Although shown for a cleat attached at the rear central portion of the helmet, the construction appearing in FIG. 21 applies to attachment to the front of the helmet or other location on the helmet.

FIG. 21 is a fragmentary, exploded view of the helmet and cleat system appearing in FIG. 20. The cleat system includes a cleat 210, which is secured to the helmet surface with an adhesive-backed securing member 240*b*, and may further include a cover 250. The cleat 210 and cover 250 appearing in FIGS. 20 and 21 may be as described above by way of reference to FIGS. 13-17.

In certain embodiments, the adhesive-backed securing member 240*b* is formed of a polymer material, such as a nylon material. In certain embodiments, the material is MDS filled nylon 6/6. An adhesive layer 242*b* is disposed on the helmet facing surface thereof. An aperture 244*b* is formed in the adhesive-backed securing member 240*b*. The base 213 extends through the aperture 244*b* and the adhesive-backed securing member 240*b* secures the flange 212 to surface of the helmet 200*b*. In certain embodiments, no adhesive is used between the helmet and the helmet facing surface of the cleat 210. In certain embodiments, an adhesive layer is used between the helmet and the helmet facing surface of the cleat 210.

Optionally, an adhesive layer may be provided on the outward facing surface 226 of the flange 212 to enhance the adhesive bond between the flange 212 and the adhesive layer 242*b*. The adhesive-backed securing member 240*b* includes a hook 246*b* which is secured around the brim 204*b*, and is disposed between the edge of the brim 204*b* and the edge trim piece 206*b*, within the channel 208*b*.

In certain embodiments, a cover 250 is provided which is removably attachable to the cleat 210 when the cleat 210 is not in use for attaching a helmet mounted-accessory device or mounting hardware. The cover 250 defines a receptacle that complementary with the shape of the cleat 210 and may include resilient members (not shown) removably engaging the cleat as described above by way of reference to the cover 150. The outer surface 254 of the cover 250 is preferably smooth and rounded to prevent snags when the helmet is worn in areas with brush or other snag hazards.

In the illustrated embodiment, the adhesive-backed securing member 240*b* is a separately formed piece, and is separate from a helmet edge trim piece 206*b* which is disposed over the unfinished brim of the helmet 200*b*. In alternative embodiments, one or more adhesive-backed securing members may be as described above, except that they are integrally formed with the helmet edge trim 206*b*.

In certain embodiments, the dimensions of the cleat 210, such as the height, diameter, and thickness of the base 213, post 214, head 216, etc., may be standardized to define a common interface standard that multiple manufactures can design to.

Figure 22:
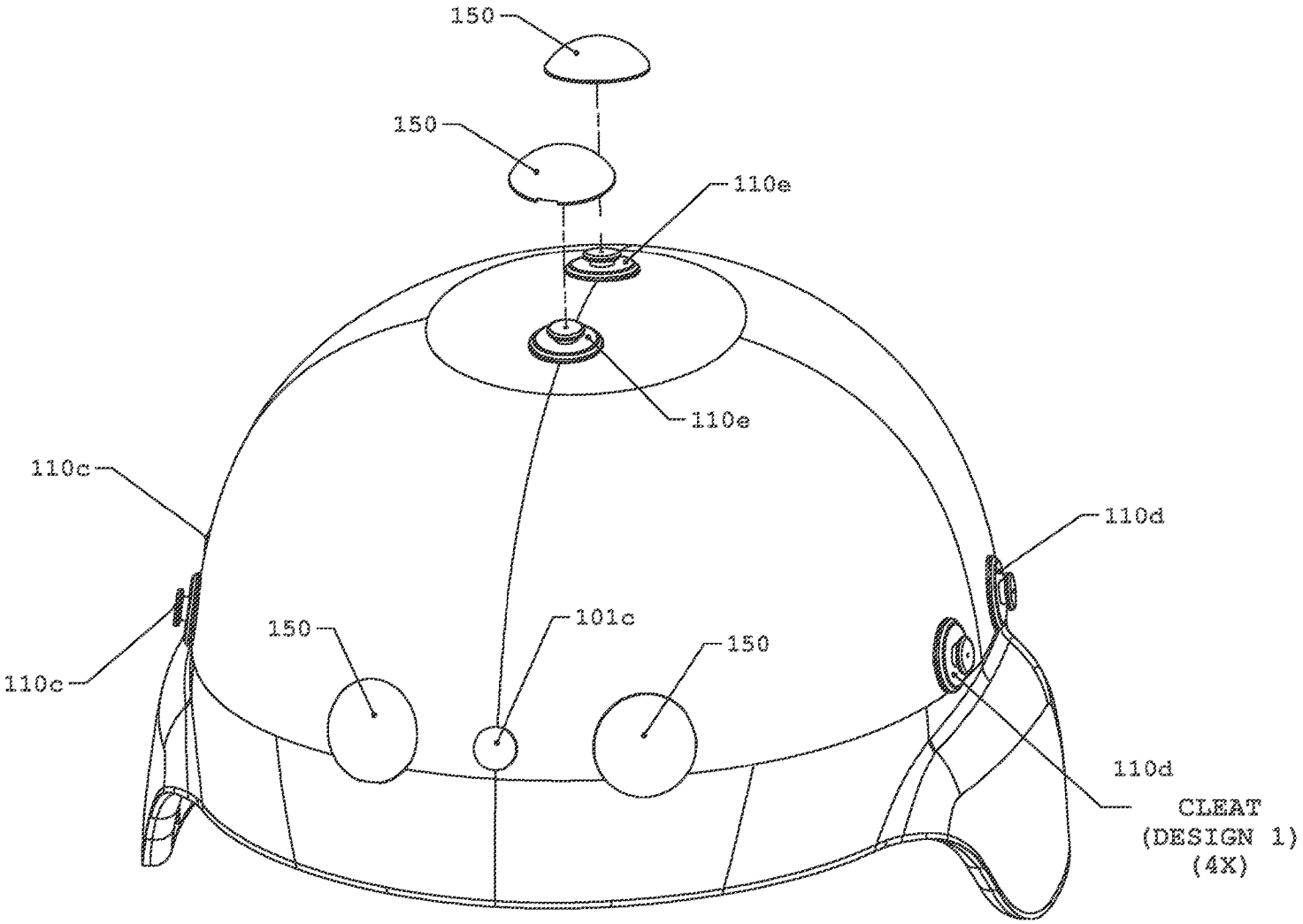
FIG. 22 is a helmet mount system according to a sixth exemplary embodiment.

Referring now to FIG. 22, there appears an exemplary helmet embodiment 100*c*, which includes 10 cleats 110 adhesively attached to the helmet 100*c*. In the configuration appearing in FIG. 22, there is a first pair of cleats 110*a* disposed on the front portion of the helmet 100*c* (shown with covers 150 attached; see uncovered from cleats 110*a* in FIG. 11) and a second pair of cleats 110*b* disposed on the rear portion of the helmet 100*c* (not shown in FIG. 22, see FIG. 11). A third pair of cleats 110*c* are disposed on the left side of the helmet (right side from the wearer's perspective), and a fourth pair of cleats 110*d* are disposed on the right side of the helmet (left side from the wearer's perspective). A fifth pair of cleats 110*e* is disposed on the top or crown of the helmet. In certain embodiments, it is contemplated that the cleats 110*a* are spaced apart and are on opposite sides of the median plane of the helmet 100*c*. Likewise, the cleats 110*b* are spaced apart and are on opposite sides of the median plane of the helmet 100*b*. The respective pairs of cleats 110*c*, 110*d*, and 110*e* are spaced apart and are disposed on opposite sides of a frontal plane passing through the helmet 100*c*.

The invention has been described with reference to the preferred embodiment. Modifications and alterations will occur to others upon a reading and understanding of the preceding detailed description. It is intended that the invention be construed as including all such modifications and alterations insofar as they fall within the scope of the appended claims and equivalents thereof.

What is claimed is:

1. A helmet mount system for attaching a device to a helmet, the helmet mount system comprising:

a mounting cleat, the mounting cleat comprising a base having a front surface and a back surface opposite the front surface, said back surface configured to receive an adhesive layer, the adhesive layer for coupling the base to a surface of the helmet;

a post portion extending from the front surface;

a head portion disposed at a distal end of said post portion, said head portion having a diameter greater than a diameter of the post portion, wherein the base, post portion, and head portion cooperate to define an annular channel; and a raised annular lip extending from the back surface and circumscribing a peripheral edge of the base portion, wherein the back surface of the base and the raised annular lip cooperate to define a cavity for receiving the adhesive layer.

2. The helmet mount system of claim 1, wherein the back surface of the base portion further comprises one or more grooves.

3. The helmet mount system of claim 1, wherein the base portion further comprises a channel, said channel extending through the base, post, and head portions.

4. The helmet mount system of claim 1, further comprising a cover, the cover configured to removably attach to the mounting cleat.

5. The helmet mount system of claim 4, wherein the cover has an outer surface, the outer surface being substantially smooth.

6. The helmet mount system of claim 4, the cover further comprising a notch configured to receive a removal tool for facilitating removal of the cover.

7. The helmet mount system of claim 1, wherein the mounting cleat is formed of a metal.

8. The helmet mount system of claim 1, further comprising the adhesive layer, the adhesive layer configured to permanently bond the back surface to the surface of the helmet.

* * * * *